US006801001B2

(12) United States Patent
Drobot et al.

(10) Patent No.: US 6,801,001 B2
(45) Date of Patent: Oct. 5, 2004

(54) METHOD AND APPARATUS FOR ADDRESSING MICRO-COMPONENTS IN A PLASMA DISPLAY PANEL

(75) Inventors: Adam T. Drobot, Vienna, VA (US); N. Convers Wyeth, Oakton, VA (US); E. Victor George, Temecula, CA (US); Albert M. Green, Springfield, VA (US)

(73) Assignee: Science Applications International Corporation, San Diego, CA (US)

( * ) Notice: Subject to any disclaimer, the term of this patent is extended or adjusted under 35 U.S.C. 154(b) by 174 days.

(21) Appl. No.: 10/214,764

(22) Filed: Aug. 9, 2002

(65) Prior Publication Data

US 2003/0214243 A1 Nov. 20, 2003

Related U.S. Application Data

(63) Continuation-in-part of application No. 09/697,345, filed on Oct. 27, 2000, now Pat. No. 6,570,335.

(51) Int. Cl.[7] ..... G09G 3/10
(52) U.S. Cl. ..... 315/169.3
(58) Field of Search ..... 315/169.3, 169.4; 313/483, 484, 491, 581, 582; 445/24, 33

(56) References Cited

U.S. PATENT DOCUMENTS

| | | | | |
|---|---|---|---|---|
| 5,914,150 A | 6/1966 | Porter et al. | ..... | 427/77 |
| 3,559,190 A | 1/1971 | Blitzer et al | ..... | 340/173 |
| 3,646,384 A | 2/1972 | Lay | ..... | 313/109.5 |
| 3,704,052 A | 11/1972 | Coleman | ..... | 316/17 |
| 3,755,027 A | 8/1973 | Gilsing | ..... | 156/67 |
| 3,848,248 A | 11/1974 | MacIntyre, Jr. | ..... | 340/324 M |
| 3,969,651 A | 7/1976 | Greeson, Jr. | ..... | 315/169 TV |
| 3,990,068 A | 11/1976 | Mayer et al. | ..... | 340/324 M |

(List continued on next page.)

FOREIGN PATENT DOCUMENTS

| | | | | |
|---|---|---|---|---|
| JP | 4-287397 | 10/1992 | ..... | H05K/9/00 |
| JP | 10-3869 | 1/1998 | ..... | H01J/31/12 |
| WO | WO 00/36465 | 6/2000 | ..... | G02F/1/167 |

OTHER PUBLICATIONS

Preliminary Examination Report for Application No. PCT/US01/42782, dated Jun. 4, 2003.
Preliminary Examination Report for Application No. PCT/US01/42803, dated Sep. 22, 2003 (mailing date).
Written Opinion for Application No. PCT/US01/42782, dated Dec. 31, 2002 (mailing date).
International Search Report for Application No. PCT/US01/51439, date Sep. 23 2002 (mailing date).
Written Opinion for Application No. PCT/US01/42807, dated Sep. 17, 2002 (mailing date).
International Search Report for Application No. PCT/US01/42807, dated May 20, 2002 (mailing date).

(List continued on next page.)

*Primary Examiner*—Tuyet Vo
*Assistant Examiner*—Minh Dieu A
(74) *Attorney, Agent, or Firm*—Kilpatrick Stockton LLP

(57) ABSTRACT

An improved light-emitting display having a plurality of micro-components sandwiched between two substrates is disclosed. Each micro-component contains a gas or gas-mixture capable of ionization when a sufficiently large trigger voltage is supplied across the micro-component by up to two triggering electrodes and ionization can be maintain by a sustain voltage supplied by up to two sustain electrodes. The display is further divided into a plurality of panels that can be individually addressed in parallel, preferably directly through the back of the panels and can include voltage multiplying circuitry to decrease the power demands for addressing circuitry. Alternative methods of addressing the micro-components include the use of directed light and arrangements of electrodes to address multiple micro-components with a single electrode.

46 Claims, 27 Drawing Sheets

U.S. PATENT DOCUMENTS

| | | | | |
|---|---|---|---|---|
| 3,998,618 | A | | 12/1976 | Kreick et al. ..... 65/105 |
| 4,027,246 | A | | 5/1977 | Caccoma et al. ..... 235/151.1 |
| 4,035,690 | A | | 7/1977 | Roeber ..... 315/169 TV |
| 4,303,433 | A | | 12/1981 | Torobin ..... 65/21.4 |
| 4,379,301 | A | | 4/1983 | Fischbeck ..... 346/1.1 |
| 4,386,358 | A | | 5/1983 | Fischbeck ..... 346/1.1 |
| 4,393,326 | A | | 7/1983 | Kamegaya et al. ..... 313/582 |
| 4,429,303 | A | | 1/1984 | Aboelfotoh ..... 340/701 |
| 4,534,743 | A | | 8/1985 | D'Onofrio et al. ..... 445/24 |
| 4,554,537 | A | * | 11/1985 | Dick ..... 345/67 |
| 4,563,617 | A | | 1/1986 | Davidson ..... 315/312 |
| 4,591,847 | A | | 5/1986 | Criscimagna et al. ..... 340/776 |
| 4,654,561 | A | | 3/1987 | Shelton ..... 315/111.71 |
| 4,658,269 | A | | 4/1987 | Rezanka ..... 346/75 |
| 4,697,123 | A | | 9/1987 | Shinoda et al. ..... 315/169.4 |
| 4,728,864 | A | | 3/1988 | Dick ..... 315/169.3 |
| 4,833,463 | A | | 5/1989 | Dick et al. ..... 340/775 |
| 4,843,281 | A | | 6/1989 | Mendelsohn ..... 313/587 |
| 4,887,003 | A | | 12/1989 | Parker ..... 313/634 |
| 4,912,364 | A | | 3/1990 | Holló et al. ..... 313/623 |
| 5,019,807 | A | | 5/1991 | Stapleton et al. ..... 340/718 |
| 5,030,888 | A | | 7/1991 | Salavin et al. ..... 315/169.4 |
| 5,062,916 | A | | 11/1991 | Aufderheide et al. ..... 156/269 |
| 5,068,916 | A | | 11/1991 | Harrison et al. ..... 455/39 |
| 5,075,597 | A | | 12/1991 | Deschamps et al. ..... 315/169.4 |
| 5,126,632 | A | | 6/1992 | Parker ..... 313/634 |
| 5,150,007 | A | | 9/1992 | Andreadakis ..... 313/586 |
| 5,315,129 | A | | 5/1994 | Forrest et al. ..... 257/21 |
| 5,396,149 | A | | 3/1995 | Kwon ..... 313/486 |
| 5,500,287 | A | | 3/1996 | Henderson ..... 428/403 |
| 5,501,871 | A | | 3/1996 | Henderson ..... 427/160 |
| 5,510,678 | A | | 4/1996 | Sakai et al. ..... 315/58 |
| 5,514,934 | A | | 5/1996 | Matsumoto et al. ..... 313/607 |
| 5,674,351 | A | | 10/1997 | Lovoi ..... 156/629.1 |
| 5,675,212 | A | | 10/1997 | Schmid et al. ..... 313/422 |
| 5,686,790 | A | | 11/1997 | Curtin et al. ..... 313/493 |
| 5,703,436 | A | | 12/1997 | Forrest et al. ..... 313/506 |
| 5,707,745 | A | | 1/1998 | Forrest et al. ..... 428/432 |
| 5,721,160 | A | | 2/1998 | Forrest et al. ..... 438/28 |
| 5,725,787 | A | | 3/1998 | Curtin et al. ..... 216/25 |
| 5,746,635 | A | | 5/1998 | Spindt et al. ..... 445/24 |
| 5,747,931 | A | | 5/1998 | Riddle et al. ..... 313/581 |
| 5,755,944 | A | | 5/1998 | Haven et al. ..... 204/486 |
| 5,757,026 | A | | 5/1998 | Forrest et al. ..... 257/40 |
| 5,757,131 | A | | 5/1998 | Tsuchiya ..... 375/582 |
| 5,757,139 | A | | 5/1998 | Forrest et al. ..... 315/169.3 |
| 5,777,782 | A | | 7/1998 | Sheridon ..... 359/296 |
| 5,788,814 | A | | 8/1998 | Sun et al. ..... 204/297 R |
| 5,793,158 | A | | 8/1998 | Wedding, Sr. ..... 313/493 |
| 5,798,604 | A | | 8/1998 | Duboc, Jr. et al. ..... 313/495 |
| 5,808,403 | A | | 9/1998 | Clerc ..... 313/336 |
| 5,811,833 | A | | 9/1998 | Thompson ..... 257/40 |
| 5,815,306 | A | | 9/1998 | Sheridon et al. ..... 359/296 |
| 5,825,451 | A | | 10/1998 | Ma et al. ..... 349/187 |
| 5,837,221 | A | | 11/1998 | Bernstein et al. ..... 424/9.52 |
| 5,844,363 | A | | 12/1998 | Gu et al. ..... 313/506 |
| 5,853,446 | A | | 12/1998 | Carre et al. ..... 65/17.3 |
| 5,862,054 | A | | 1/1999 | Li ..... 364/468.28 |
| 5,865,657 | A | | 2/1999 | Haven et al. ..... 445/24 |
| 5,897,414 | A | | 4/1999 | Bergeron et al. ..... 445/3 |
| 5,898,266 | A | | 4/1999 | Spindt et al. ..... 313/495 |
| 5,913,704 | A | | 6/1999 | Spindt et al. ..... 445/24 |
| 5,917,646 | A | | 6/1999 | Sheridon ..... 359/296 |
| 5,920,080 | A | | 7/1999 | Jones ..... 257/40 |
| 5,945,174 | A | | 8/1999 | Shaw et al. ..... 427/509 |
| 5,949,513 | A | | 9/1999 | Ma et al. ..... 349/187 |
| 5,953,587 | A | | 9/1999 | Forrest et al. ..... 438/99 |
| 5,964,630 | A | | 10/1999 | Slusarczuk et al. ..... 445/25 |
| 5,965,109 | A | | 10/1999 | Lohrmann ..... 424/9.52 |
| 5,967,871 | A | | 10/1999 | Kaake et al. ..... 445/24 |
| 5,969,472 | A | | 10/1999 | Kisner ..... 313/484 |
| 5,975,683 | A | | 11/1999 | Smith et al. ..... 347/55 |
| 5,984,747 | A | | 11/1999 | Bhagavatula et al. ..... 445/24 |
| 5,985,460 | A | | 11/1999 | Wang et al. ..... 428/426 |
| 5,986,409 | A | | 11/1999 | Farnworth et al. ..... 315/169.4 |
| 5,990,614 | A | | 11/1999 | Spindt ..... 313/495 |
| 5,990,620 | A | | 11/1999 | Lepselter ..... 313/585 |
| 6,002,198 | A | | 12/1999 | Spindt et al. ..... 313/292 |
| 6,013,538 | A | | 1/2000 | Burrows et al. ..... 438/22 |
| 6,017,584 | A | | 1/2000 | Albert et al. ..... 427/213.3 |
| 6,019,657 | A | | 2/2000 | Chakvorty et al. ..... 445/24 |
| 6,022,652 | A | | 2/2000 | Haven et al. ..... 430/26 |
| 6,023,259 | A | | 2/2000 | Howard et al. ..... 345/76 |
| 6,025,097 | A | | 2/2000 | Drumm ..... 430/7 |
| 6,030,269 | A | | 2/2000 | Drumm ..... 445/52 |
| 6,030,715 | A | | 2/2000 | Thompson et al. ..... 428/690 |
| 6,033,547 | A | | 3/2000 | Trau et al. ..... 204/622 |
| 6,037,710 | A | | 3/2000 | Poole et al. ..... 313/422 |
| 6,037,918 | A | | 3/2000 | Hansen et al. ..... 345/74 |
| 6,038,002 | A | | 3/2000 | Song ..... 349/43 |
| 6,039,619 | A | | 3/2000 | Kang et al. ..... 445/24 |
| 6,045,930 | A | | 4/2000 | Thompson et al. ..... 428/690 |
| 6,046,543 | A | | 4/2000 | Bulovic et al. ..... 313/504 |
| 6,048,469 | A | | 4/2000 | Xiang et al. ..... 252/301.6 R |
| 6,048,630 | A | | 4/2000 | Burrows et al. ..... 428/690 |
| 6,049,366 | A | | 4/2000 | Hakemi et al. ..... 349/86 |
| 6,069,443 | A | | 5/2000 | Jones et al. ..... 313/504 |
| 6,072,276 | A | | 6/2000 | Okajima ..... 313/581 |
| 6,079,814 | A | | 6/2000 | Lean et al. ..... 347/55 |
| 6,080,606 | A | | 6/2000 | Gleskova et al. ..... 438/151 |
| 6,087,196 | A | | 7/2000 | Sturm et al. ..... 438/29 |
| 6,091,195 | A | | 7/2000 | Forrest et al. ..... 313/504 |
| 6,091,380 | A | | 7/2000 | Hashimoto et al. ..... 345/60 |
| 6,091,874 | A | | 7/2000 | Higashi et al. ..... 384/130 |
| 6,097,147 | A | | 8/2000 | Baldo et al. ..... 313/506 |
| 6,130,655 | A | | 10/2000 | Lammers ..... 345/72 |
| 6,137,553 | A | | 10/2000 | Izumi et al. ..... 349/49 |
| 6,201,518 | B1 | | 3/2001 | Kane et al. ..... 345/60 |
| 6,255,777 | B1 | | 7/2001 | Kim et al. ..... 313/582 |
| 6,262,706 | B1 | | 7/2001 | Albert et al. ..... 345/107 |
| 6,265,826 | B1 | | 7/2001 | Miyazaki ..... 313/586 |
| 6,281,863 | B1 | | 8/2001 | Sasaki et al. ..... 345/60 |
| 6,285,129 | B1 | | 9/2001 | Park et al. ..... 313/586 |
| 6,285,434 | B1 | | 9/2001 | Ma et al. ..... 349/189 |
| 6,288,488 | B1 | | 9/2001 | Amemiya ..... 313/582 |
| 6,288,693 | B1 | | 9/2001 | Song et al. ..... 345/68 |
| 6,291,925 | B1 | | 9/2001 | Jacobson ..... 310/319 |
| 6,292,159 | B1 | | 9/2001 | Someya et al. ..... 345/60 |
| 6,292,160 | B1 | | 9/2001 | Mikoshiba et al. ..... 345/60 |
| 6,295,040 | B1 | | 9/2001 | Nhan et al. ..... 345/60 |
| 6,296,539 | B1 | | 10/2001 | Awaji et al. ..... 445/24 |
| 6,297,590 | B1 | | 10/2001 | Nanto et al. ..... 313/586 |
| 6,300,152 | B1 | | 10/2001 | Kim ..... 438/30 |
| 6,300,932 | B1 | | 10/2001 | Albert ..... 345/107 |
| 6,304,031 | B1 | | 10/2001 | Wani et al. ..... 313/582 |
| 6,304,032 | B1 | | 10/2001 | Asano ..... 313/582 |
| 6,304,238 | B1 | | 10/2001 | Tsuchida ..... 345/87 |
| 6,307,319 | B1 | | 10/2001 | Lee ..... 313/590 |
| 6,312,304 | B1 | | 11/2001 | Duthaler et al. ..... 445/24 |
| 6,312,971 | B1 | | 11/2001 | Amundson et al. ..... 438/99 |
| 6,319,325 | B1 | | 11/2001 | Hiratsuka et al. ..... 118/718 |
| 6,322,010 | B1 | | 11/2001 | Sasaki et al. ..... 239/568 |
| 6,607,413 | B2 | * | 8/2003 | Stevenson et al. ..... 445/24 |
| 6,655,788 | B1 | * | 12/2003 | Freeman ..... 347/58 |
| 6,657,772 | B2 | * | 12/2003 | Loxley ..... 359/296 |
| 6,672,921 | B1 | * | 1/2004 | Liang et al. ..... 445/24 |
| 2001/0008825 | A1 | | 7/2001 | Toyoda et al. ..... 445/24 |
| 2001/0033256 | A1 | | 10/2001 | Moore ..... 345/60 |
| 2001/0053570 | A1 | | 12/2001 | Kido ..... 438/149 |
| 2002/0008470 | A1 | | 1/2002 | Uegaki et al. ..... 313/567 |
| 2002/0009536 | A1 | | 1/2002 | Iguchi et al. ..... 427/10 |

| | | | | |
|---|---|---|---|---|
| 2002/0016075 | A1 | 2/2002 | Peng et al. | 438/700 |
| 2002/0017864 | A1 | 2/2002 | Watanabe et al. | 313/586 |
| 2002/0022565 | A1 | 2/2002 | Sreeram et al. | 501/16 |
| 2002/0024295 | A1 | 2/2002 | Miyashita et al. | 313/495 |
| 2003/0025855 | A1 * | 2/2003 | Holman et al. | 349/86 |

OTHER PUBLICATIONS

International Search Report for Application No. PCT/US01/42782, dated Apr. 11, 2002 (mailing date).

Sheats, James, "Introduction to Organic Light–Emitting Diodes (OLEDs)" [online], [retrieved on May 9, 2002], 8 pp., Retrieved from the Internet: http://www.rolltronics.com/intro_oled.htm.

Sauvante, Michael, "Roll–to–Roll Manufacturing" [online], [retrieved on May 9, 2002], 4 pp., Retrieved from the Internet: http://www.rolltronics.com/roll2roll.htm.

Veronis, Georgios and Inan, Umran S., "Optimization of the Luminous Efficiency of Plasma Display Panels Using Numerical Modeling" [online], [retrieved on Mar. 13, 2002], 8 pp., Retrieved from the Internet: http:www.star.stanford.edu/~vlf/plasma_display/index.htm.

Smilgys, Russell, et al., "Progress Toward Roll Processing of Solar Reflective Material," *Proceedings of Solar Forum 2001 Solar Energy: The Power to Choose*, Washington, DC, 8 pp., Apr. 21–25, 2001.

Srinivasan, Uthara, et al., "Microstructure to Substrate Self–Assembly Using Capillary Forces," *Nournal of Microelectromechanical Systems*, vol. 10, No. 1, Mar., 2001. pp. 17–17–24.

Chutinan, Alongkarn and Noda, Susumu, "Waveguides and Waveguide Bends in Two–Dimensional Photonic Crystal Slabs," *The American Physical Society*, vol. 62, No. 7, 5 pp., Aug. 15, 2000.

"Rolltronics" [online], Feb. 20, 2000 [retrieved on Mar. 12, 2000], 13 pp., Retrieved from the Internet: http://www.rolltronics.com.

"Electronics & Telecommunications" [online], LG Electronics, Copyright 2001 [retrieved on Nov. 7, 2001], 1 p., Retrieved from the Internet: http://www.lg.co.kr/English/company/electronic/index.jsp?code=A3.

"New Product" [online], LG Electronics, Copyright 2001 [retrieved on Nov. 7, 2001], 1 p., Retrieved from the Internet:http://www.lge.com.

"Monitor" [online], LG Electronics, Copyright 2001 [retrieved on Nov. 7, 2001], 2 pp., Retrieved from the Internet: http://www.lgeus.com/Product/Monitor/newmonitors.asp.

"LG Electronics Introduces 42–Inch Digital PDP TV" [online], LG Electronics, Copyright 2001 [retrieved on Nov. 7, 2001], 2 pp., Retrieved from the Internet: http://www.pdpdisplay.com/eng/news/e_read.as?nSeqno=22.

"LG PDP Now Available at World Renowned Harrods Department Store" [online], LG Electronics, Copyright 2001 [retrieved on Nov. 7, 2001], 2 pp., Retrieved from the Internet: http://www.pdpdisplay.com/eng/news/e_read.asp?nSeqno21.

"LG Electronics Becomes First in Korea to Export PDP Module" [online], LG Electronics, Copyright 2001 [retrieved on Nov. 7, 2001], 2 pp., Retrieved from the Internet: http://www.pdpdisplay.com/eng/news/e_read.asp?nSeqNo=19&type=&word=.

"LG Electronics –To the Top in PDP Business" [online], LG Electronics, Copyright 2001 [retrieved on Nov. 7, 2001], 2 pp., Retrieved from the Internet: http://www.pdpdisplay.com/eng/news/e_read.asp?nSeqNo=16&type=&word=.

"LG Electronics Becomes the First in Korea to Export PDP" [online], LG Electronics, Copyright 2001 [retrieved on Nov. 7, 2001], 2 pp., Retrieved from the Internet: http://www.pdpdisplay.com/eng/news/e_read.asp?nSeqNo=14&type=&word=.

"LG Electronics Held the Ceremony for the Completion of the PDP Factory" [online], LG Electronics, Copyright 2001 [retrieved on Nov. 7, 2001], 2 pp., Retrieved from the Internet: http://www.pdpdisplay.com/eng/news/e_read.asp?nSeqNo=13&type=&word.

"Runco Plasma Wall Systems with Vivex Processing" [online], Copyright 2001 [retrieved on Jan. 17, 2002], 2 pp., Retrieved from the Internet: http://www.runco.com/Products/Plasma/Default.htm.

"Runco Plasma Wall PL–42cx" [online], Copyright 2001 [retrieved on Jan. 17, 2002], 2 pp., Retrieved from the Internet: http://www.runco.com/Products/Plasma/PL42cx.htm.

"Runco Plasma Wall PI–50c" [online], Copyright 2001 [retrieved on Jan. 17, 2002], 2 pp., Retrieved from the Internet: http://www.runco.com/Products/Plasma/PL50c.htm.

"Runco Plasma Wall™ PL–61cx" [online], Copyright 2001 [retrieved on Jan. 17, 2002], 2 pp., Retrieved from the Internet: http://www.runco.com/Products/Plasma/PL61.htm.

Alien Technology Corporation's Technology Overview; copyright © 2000, Alien Technology™; http://www.alientechnology.com/d/technology/overview.html.

Anonymous, *Alien Technology Corporation White Paper – Fluidic Self Assembly*, Alien Technology Corp., Oct. 1999, pp. 1–7.

Shin, Y. K., Lee, J. K., Shon, C. H., "Two–Dimensional Breakdown Characteristics of PDP Cells for Varying Geometry," *IEEE Transactions on Plasma Science*, vol. 27, No. 1, Feb., 1999, pp. 14–15.

Raulf, S., Kushner, M. J., "Operation of a Coplanar–Electrode Plasma Display Panel Cell," *IEEE Transactions on Plasma Science*, vol. 27, No. 1, Feb. 1999, pp. 10–11.

Kurihara, M., Makabe, T., "Two–Dimensional Modeling of a Micro–Cell Plasma in Xe Driven by High Frequency," *IEEE Transactions on Plasma Science*, vol. 27, No. 5, Oct., 1999, pp. 1372–1378.

Peterson, "Rethinking Ink" [online], Science News, vol. 153, No. 25, Jun. 20, 1998 [retrieved on Dec. 4, 2002], 7 pp., Retrieved from the Internet: http://www.sciencenews.org/sn_arc98/6_20_98/bob2.htm.

"Transparent Conductive Coatings," Copyright 1998, 4 pp.

Lin, Yi–Zhen, et al., "A New Method of Analyzing the Light Transmission in Leaky and Absorbing Planar Waveguides," *IEEE Photonics Technology Letters*, vol. 9, No. 9, Sep., 1997, pp. 1241.

Jacobson, et al., "The Last Book" [online], IBM Systems Journal, vol. 36, No. 3, 1997 [retrieved on Dec. 4, 2002], 6 pp., Retrieved from the Internet: http://www.research.ibm.com/journal/sj/363/Jacobson.html.

Stearns, Thomas H., "Flexible Printed Circuitry," 6 pp., 1996.

"Flat Panel Displays in Perspective," 44 pp., Sep., 1995.

Franjione, et al., "The Art and Science of Microencapsulation" [online] Technology Today, Summer, 1995 [retrieved on Dec. 4, 2002], 10 pp., Retrieved from the Internet: http://www.swri.edu/3pubs/ttoday/summer95/microeng.htm.

International Search Report for Application No. PCT/US01/42803, dated Dec. 9, 2002 (mailing date).

* cited by examiner

METHOD AND APPARATUS FOR ADDRESSING MICRO-COMPONENTS IN A PLASMA DISPLAY PANEL

CROSS-REFERENCE TO RELATED APPLICATIONS

The following application is a Continuation-In-Part of co-pending U.S. patent application Ser. No. 09/697,345 filed Oct. 27, 2000 now U.S. Pat. No. 6,570,335.

The entire disclosures of U.S. patent application Ser. Nos. 09/697,498, 09/697,346, 09/697,358, and 09/697,344 all of which were filed on Oct. 27, 2000 are hereby incorporated herein by reference. In addition, the entire disclosures of the following applications filed on the same date as the present application are hereby incorporated herein by reference: Method for On-line Testing of a Light-Emiting Panel; Design, Fabrication, Testing and Conditioning of Micro-Components for Use in a Light-Emitting Panel; Liquid Manufacturing Process for Panel Layer Fabrication; and Use of Printing and Other Technology for Micro-Component Placement.

BACKGROUND OF THE INVENTION

1. Field of the Invention

The present invention relates to methods and systems for addressing and energizing micro-components in a light-emitting display.

2. Description of Related Art

In a typical plasma display, a gas or mixture of gases is enclosed between orthogonally crossed and spaced conductors. The crossed conductors define a matrix of cross over points, arranged as an array of miniature picture elements (pixels), which provide light. At any given pixel, the orthogonally crossed and spaced conductors function as opposed plates of a capacitor, with the enclosed gas serving as a dielectric. When a sufficiently large voltage is applied, the gas at the pixel breaks down creating free electrons that are drawn to the positive conductor and positively charged gas ions that are drawn to the negatively charged conductor. These free electrons and positively charged gas ions collide with other gas atoms causing an avalanche effect creating still more free electrons and positively charged ions, thereby creating plasma. The voltage level at which this ionization occurs is called the write voltage.

Upon application of a write voltage, the gas at the pixel ionizes and emits light only briefly as free charges formed by the ionization migrate to the insulating dielectric walls of the cell where these charges produce an opposing voltage to the applied voltage and thereby extinguish the ionization. Once a pixel has been written, a continuous sequence of light emissions can be produced by an alternating sustain voltage. The amplitude of the sustain waveform can be less than the amplitude of the write voltage, because the wall charges that remain from the preceding write or sustain operation produce a voltage that adds to the voltage of the succeeding sustain waveform applied in the reverse polarity to produce the ionizing voltage. Mathematically, the idea can be set out as $V_s=V_w-V_{wall}$, where $V_s$ is the sustain voltage, $V_w$ is the write voltage, and $V_{wall}$ is the wall voltage. Accordingly, a previously unwritten (or erased) pixel cannot be ionized by the sustain waveform alone. An erase operation can be thought of as a write operation that proceeds only far enough to allow the previously charged cell walls to discharge; it is similar to the write operation except for timing and amplitude.

Typically, there are two different arrangements of conductors that are used to perform the write, erase, and sustain operations. The one common element throughout the arrangements is that the sustain and the address electrodes are spaced apart with the plasma-forming gas in between. Thus, at least one of the address or sustain electrodes is located within the path the radiation travels, when the plasma-forming gas ionizes, as it exits the plasma display. Consequently, transparent or semi-transparent conductive materials must be used, such as indium tin oxide (ITO), so that the electrodes do not interfere with the displayed image from the plasma display. Using ITO, however, has several disadvantages, for example, ITO is expensive and adds significant cost to the manufacturing process and ultimately the final plasma display.

The first arrangement uses two orthogonally crossed conductors, one addressing conductor and one sustaining conductor. In a gas panel of this type, the sustain waveform is applied across all the addressing conductors and sustain conductors so that the gas panel maintains a previously written pattern of light emitting pixels. For a conventional write operation, a suitable write voltage pulse is added to the sustain voltage waveform so that the combination of the write pulse and the sustain pulse produces ionization. In order to write an individual pixel independently, each of the addressing and sustain conductors has an individual selection circuit. Thus, applying a sustain waveform across all the addressing and sustain conductors, but applying a write pulse across only one addressing and one sustain conductor will produce a write operation in only the one pixel at the intersection of the selected addressing and sustain conductors.

The second arrangement uses three conductors. In panels of this type, called coplanar sustaining panels, each pixel is formed at the intersection of three conductors, one addressing conductor and two parallel sustaining conductors. In this arrangement, the addressing conductor orthogonally crosses the two parallel sustaining conductors. With this type of panel, the sustain function is performed between the two parallel sustaining conductors and the addressing is done by the generation of discharges between the addressing conductor and one of the two parallel sustaining conductors.

The sustaining conductors are of two types, addressing-sustaining conductors and solely sustaining conductors. The function of the addressing-sustaining conductors is twofold: to achieve a sustaining discharge in cooperation with the solely sustaining conductors; and to fulfill an addressing role. Consequently, the addressing-sustaining conductors are individually selectable so that an addressing waveform may be applied to any one or more addressing-sustaining conductors. The solely sustaining conductors, on the other hand, are typically connected in such a way that a sustaining waveform can be simultaneously applied to all of the solely sustaining conductors so that they can be carried to the same potential in the same instant.

Numerous types of plasma panel display devices have been constructed with a variety of methods for enclosing a plasma forming gas between sets of electrodes. In one type of plasma display panel, parallel plates of glass with wire electrodes on the surfaces thereof are spaced uniformly apart and sealed together at the outer edges with the plasma forming gas filling the cavity formed between the parallel plates. Although widely used, this type of open display structure has various disadvantages. The sealing of the outer edges of the parallel plates and the introduction of the plasma forming gas are both expensive and time-consuming processes, resulting in a costly end product. In addition, it is particularly difficult to achieve a good seal at the sites where the electrodes are fed through the ends of the parallel plates. This can result in gas leakage and a shortened product lifecycle. Another disadvantage is that individual pixels are not segregated within the parallel plates. As a result, gas ionization activity in a selected pixel during a write operation may spill over to adjacent pixels, thereby raising the undesirable prospect of possibly igniting adjacent pixels. Even if adjacent pixels are not ignited, the ionization activity can change the turn-on and turn-off characteristics of the nearby pixels.

In another type of known plasma display, individual pixels are mechanically isolated either by forming trenches in one of the parallel plates or by adding a perforated insulating layer sandwiched between the parallel plates. These mechanically isolated pixels, however, are not completely enclosed or isolated from one another because there is a need for the free passage of the plasma forming gas between the pixels to assure uniform gas pressure throughout the panel. While this type of display structure decreases spill over, spill over is still possible because the pixels are not in total electrical isolation from one another. In addition, in this type of display panel it is difficult to properly align the electrodes and the gas chambers, which may cause pixels to misfire. As with the open display structure, it is also difficult to get a good seal at the plate edges. Furthermore, it is expensive and time consuming to introduce the plasma producing gas and seal the outer edges of the parallel plates.

In yet another type of known plasma display, individual pixels are also mechanically isolated between parallel plates. In this type of display, the plasma forming gas is contained in transparent spheres formed of a closed transparent shell. Various methods have been used to contain the gas filled spheres between the parallel plates. In one method, spheres of varying sizes are tightly bunched and randomly distributed throughout a single layer, and sandwiched between the parallel plates. In a second method, spheres are embedded in a sheet of transparent dielectric material and that material is then sandwiched between the parallel plates. In a third method, a perforated sheet of electrically nonconductive material is sandwiched between the parallel plates with the gas filled spheres distributed in the perforations.

While each of the types of displays discussed above are based on different design concepts, the manufacturing approach used in their fabrication is generally the same. Conventionally, a batch fabrication process is used to manufacture these types of plasma panels. As is well known in the art, in a batch process individual component parts are fabricated separately, often in different facilities and by different manufacturers, and then brought together for final assembly where individual plasma panels are created one at a time. Batch processing has numerous shortcomings, such as, for example, the length of time necessary to produce a finished product. Long cycle times increase product cost and are undesirable for numerous additional reasons known in the art. For example, a sizeable quantity of substandard, defective, or useless fully or partially completed plasma panels may be produced during the period between detection of a defect or failure in one of the components and an effective correction of the defect or failure.

This is especially true of the first two types of displays discussed above; the first having no mechanical isolation of individual pixels, and the second with individual pixels mechanically isolated either by trenches formed in one parallel plate or by a perforated insulating layer sandwiched between two parallel plates. Due to the fact that plasma-forming gas is not isolated at the individual pixel/subpixel level, the fabrication process precludes the majority of individual component parts from being tested until the final display is assembled. Consequently, the display can only be tested after the two parallel plates are sealed together and the plasma-forming gas is filled inside the cavity between the two plates. If post production testing shows that any number of potential problems have occurred, (e.g. poor luminescence or no luminescence at specific pixels/subpixels) the entire display is discarded.

SUMMARY OF THE INVENTION

The present invention provides a light-emitting display or panel that can function as a large-area radiation source, as an energy modulator, as a particle detector, or as a flat-panel display such as a plasma-type display. Gas-plasma panels are preferred for these applications due to their unique characteristics.

The light-emitting display is used as a large area radiation source. By configuring the light-emitting display to emit ultraviolet (UV) light, the display has application for curing, painting, and sterilization. With the addition of one or more phosphor coatings to convert the UV light to visible white light, the display also has application as an illumination source.

Alternatively, the light-emitting display may be used as a plasma-switched phase array by configuring the display in a microwave transmission mode. The display is configured such that during ionization the plasma-forming gas creates a localized index of refraction change for the microwaves (although other wavelengths of light would work). The microwave beam from the display can then be steered or directed in any desirable pattern by introducing at a localized area a phase shift, directing the microwaves out of a specific aperture in the display, or a combination thereof.

Additionally, the light-emitting display is used for particle/photon detection. In this embodiment, the light-emitting display is subjected to a potential that is just slightly below the write voltage required for ionization. When the device is subjected to outside energy at a specific position or location in the panel, that additional energy causes the plasma forming gas in the specific area to ionize, thereby providing a means of detecting outside energy.

Further, the light-emitting display is used as a flat-panel display. This display can be manufactured very thin and lightweight, when compared to similar sized cathode ray tube (CRTs), making it ideally suited for home, office, theaters and billboards. In addition, this display can be manufactured in large sizes and with sufficient resolution to accommodate high-definition television (HDTV). Gas-plasma panels do not suffer from electromagnetic distortions and are, therefore, suitable for applications strongly affected by magnetic fields, such as military applications, radar systems, railway stations and other underground systems.

According to one embodiment of the present invention, a light-emitting display is made from two substrates, wherein one of the substrates includes a plurality of sockets and wherein at least two electrodes are disposed. At least partially disposed in each socket is a micro-component, although more than one micro-component may be disposed therein. Each micro-component includes a shell at least partially filled with a gas or gas mixture capable of ionization. When a large enough voltage is applied across the micro-component the gas or gas mixture ionizes, forming plasma and emitting radiation.

In another embodiment of the present invention, the plurality of sockets include a cavity that is patterned in the first substrate and at least two electrodes adhered to the first substrate, the second substrate or any combination thereof.

The plurality of sockets can include a cavity that is patterned in the first substrate and at least two electrodes that are arranged so that voltage supplied to the electrodes causes at least one micro-component to emit radiation throughout the field of view of the light-emitting display without the radiation crossing the electrodes.

In another embodiment, the first substrate includes a plurality of material layers and a socket formed by selectively removing a portion of the plurality of material layers to form a cavity. At least one electrode is disposed on or within the material layers.

The socket can include a cavity patterned in a first substrate, a plurality of material layers disposed on the first substrate so that the plurality of material layers conform to the shape of the socket and at least one electrode disposed within the material layers.

In one embodiment, a plurality of material layers, each including an aperture, are disposed on a substrate. In this embodiment, the material layers are disposed so that the apertures are aligned, thereby forming a cavity.

The present invention is also directed to methods of addressing and triggering selected micro-components in the light-emitting display and to configurations of the light-emitting display that support these addressing methods. For example, the light-emitting display can be divided, either logically or physically into a plurality of electrically coupled panels. Each one of these panels can be provided with separate circuitry to address and trigger the micro-components contained within that particular panel. The function of sustaining the micro-components components is preferably handled simultaneously for all of the micro-components in the display. The panels can be addressed in parallel, providing for more efficient display operation. In addition, the triggering electrodes can be attached to voltage sources directly through the back of the panel or at the junctions of the panels, simplifying the circuitry and addressing schemes and increasing manufacturing flexibility by enabling the manufacture of multiple display sizes on a single fabrication line.

In order to decrease the voltages necessary to address and trigger selected micro-components as well as to eliminate the cost associated with high voltage electronics, the display includes one or more voltage multipliers. When combined with a display divided into panels, at least one voltage multiplier is provided for each panel. Addressing of micro-components can then be handled with low voltage, i.e. from about 0 volts up to about 20 volts, circuitry and then this low voltage can be increased or ramped-up by the voltage multiplier just prior to delivery to the selected micro-components.

Selected individual micro-components in the display of the present invention can also be triggered using light. A pure two electrode configuration is used to simultaneously subject all of the micro-components to a sustain voltage below the trigger voltage. Light or photons from a light source are then directed to the selected micro-components, causing an effective decrease in the triggering voltage of the gas of those micro-components and producing radiation.

Another arrangement of light-emitting display provides for adequate operation of the display using only about half the number of sustain electrodes. In this arrangement, the sustain electrodes are disposed between parallel rows of micro-components, and each sustain electrode is electrically connected to the micro-components in both rows between which it is disposed. Therefore, one sustain electrode can be used to address two micro-components simultaneously, one micro-component on either side of the sustain electrode. Therefore, the total number of sustain electrodes needed to address all of the micro-components is reduced, preferably by about 50%.

BRIEF DESCRIPTION OF THE DRAWINGS

The foregoing and other objects, features and advantages of this invention will become more apparent by reference to the following detailed description of the invention taken in conjunction with the accompanying drawings, wherein.

DETAILED DESCRIPTION OF PREFERRED EMBODIMENTS OF THE INVENTION

As embodied and broadly described herein, the preferred embodiments of the present invention are directed to a novel light-emitting display. In particular, preferred embodiments are directed to light-emitting displays and to a web fabrication process for manufacturing light-emitting displays.

Figure 1:
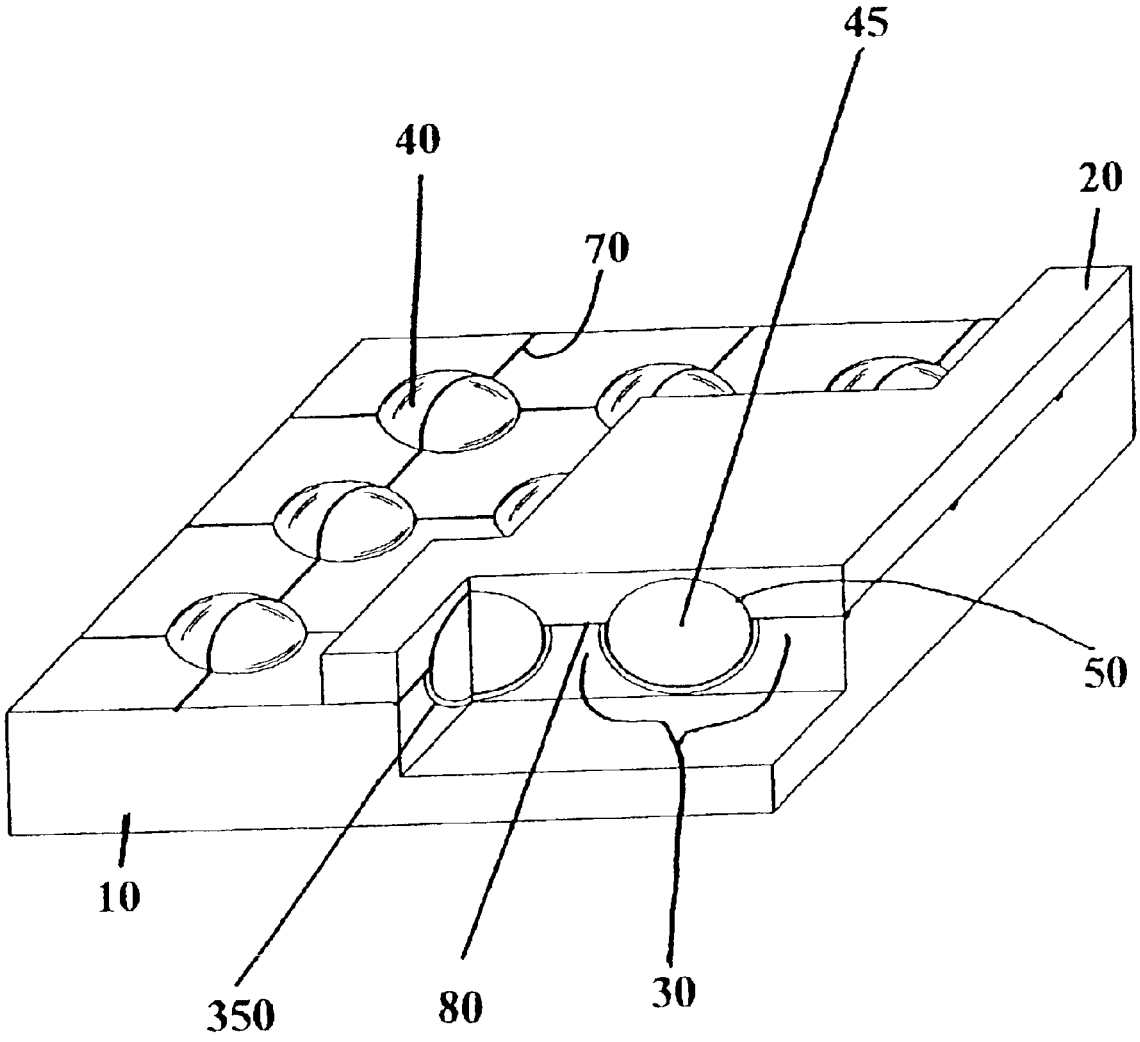
FIG. 1 depicts a portion of a light-emitting display showing the basic structure of a socket formed from patterning a substrate, as disclosed in an embodiment of the present invention.
Figure 2:
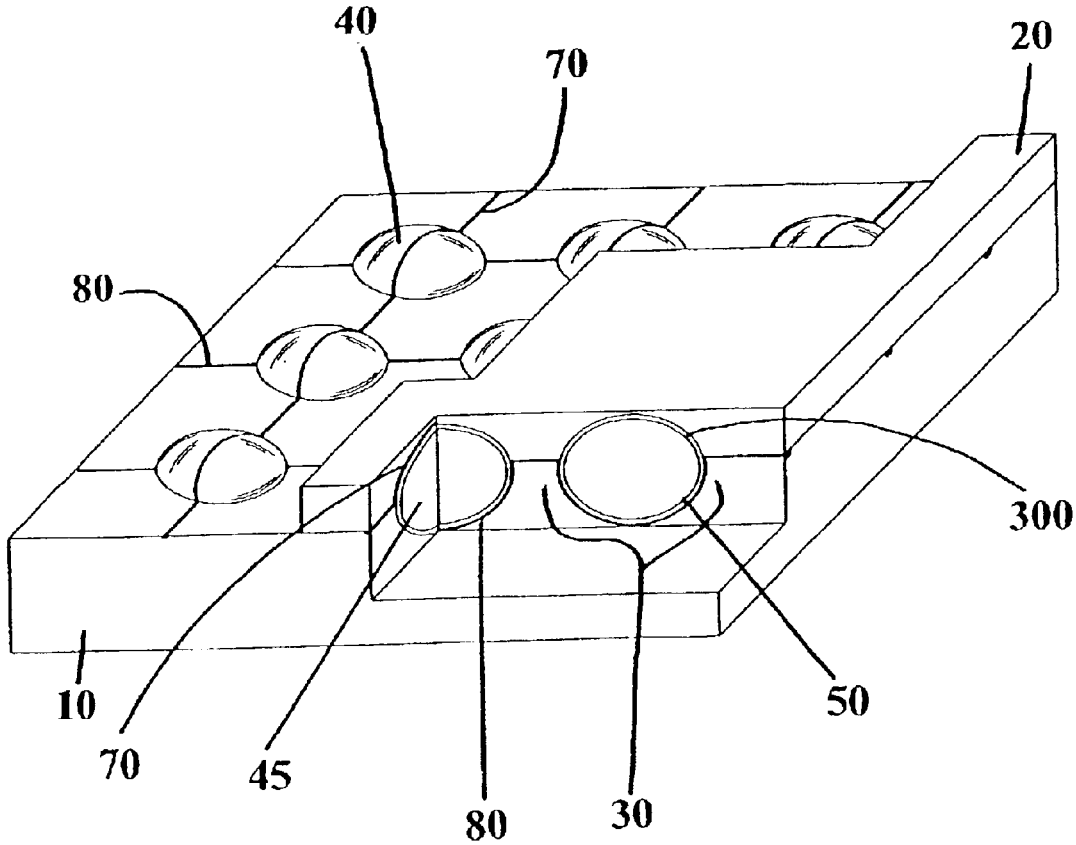
FIG. 2 depicts a portion of a light-emitting display showing the basic structure of a socket formed from patterning a substrate, as disclosed in another embodiment of the present invention.
Figure 3A:
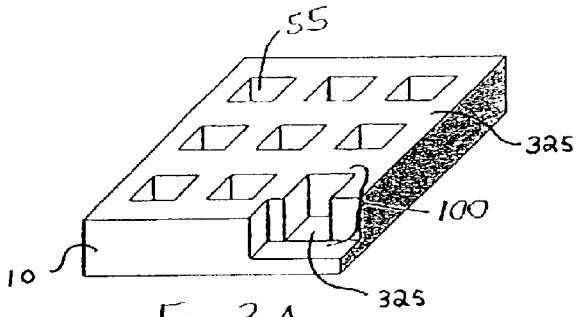
FIG. 3A shows an example of a cavity that has a cube shape.
Figure 3B:
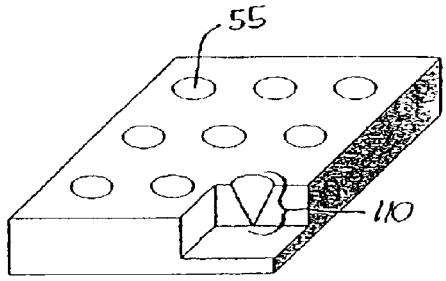
FIG. 3B shows an example of a cavity that has a cone shape.
Figure 3C:
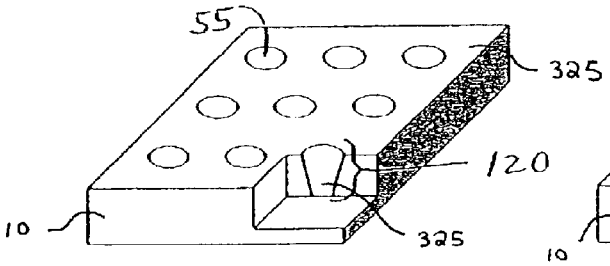
FIG. 3C shows an example of a cavity that has a conical frustum shape.
Figure 3D:
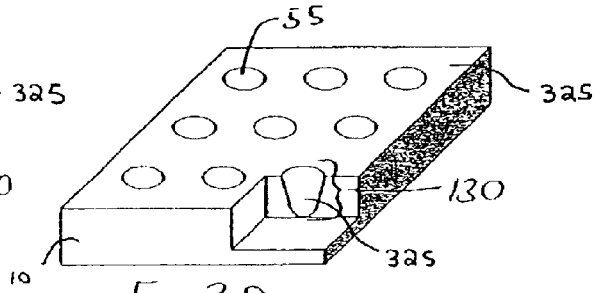
FIG. 3D shows an example of a cavity that has a paraboloid shape.
Figure 3E:
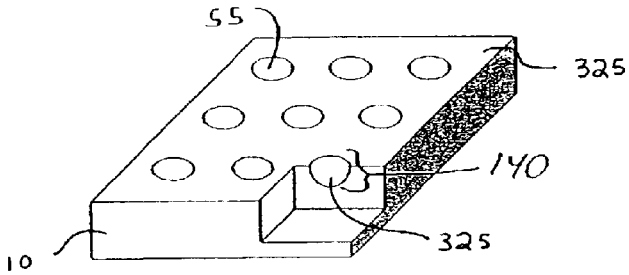
FIG. 3E shows an example of a cavity that has a spherical shape.
Figure 3F:
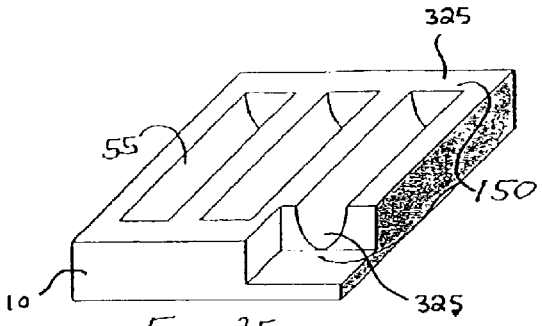
FIG. 3F shows an example of a cavity that has a cylindrical shape.
Figure 3G:
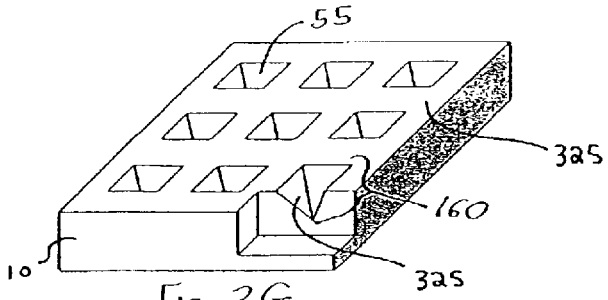
FIG. 3G shows an example of a cavity that has a pyramid shape.
Figure 3H:
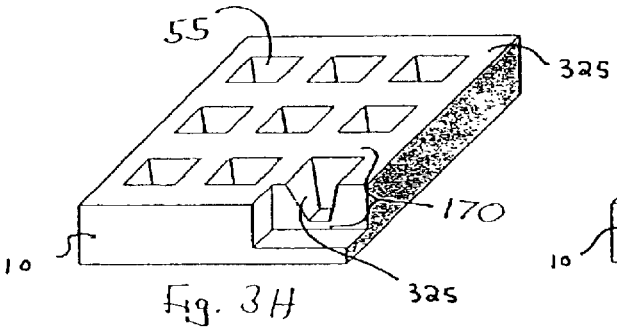
FIG. 3H shows an example of a cavity that has a pyramidal frustum shape.
Figure 3I:
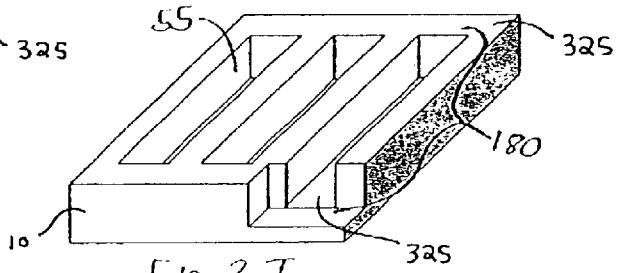
FIG. 3I shows an example of a cavity that has a parallelepiped shape.
Figure 3J:
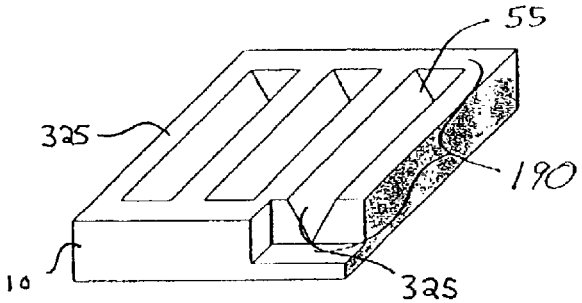
FIG. 3J shows an example of a cavity that has a prism shape.

FIGS. 1 and 2 show two embodiments of the present invention wherein a light-emitting display includes a first substrate 10 and a second substrate 20. The first substrate 10 may be made from silicates, polypropylene, quartz, glass, any polymeric-based material or any material or combination of materials known to one skilled in the art. Similarly, second substrate 20 may be made from silicates, polypropylene, quartz, glass, any polymeric-based material or any material or combination of materials known to one skilled in the art. First substrate 10 and second substrate 20 may both be made from the same material or each of a different material. Additionally, the first and second substrates may be made of a material that dissipates heat from the light-emitting display. In a preferred embodiment, each substrate is made from a material that is mechanically flexible.

The first substrate 10 includes a plurality of sockets 30. The sockets 30 may be disposed in any pattern, having uniform or non-uniform spacing between adjacent sockets. Patterns may include, but are not limited to, alphanumeric characters, symbols, icons, or pictures. Preferably, the sockets 30 are disposed in the first substrate 10 so that the distance between adjacent sockets 30 is approximately equal. Sockets 30 may also be disposed in groups such that the distance between one group of sockets and another group of sockets is approximately equal. This latter approach may be particularly relevant in color light-emitting displays, where each socket in each group of sockets may represent red, green and blue, respectively.

At least partially disposed in each socket 30 is at least one micro-component 40. Multiple micro-components may be disposed in a socket to provide increased luminosity and enhanced radiation transport efficiency. In a color light-emitting display according to one embodiment of the present invention, a single socket supports three micro-components configured to emit red, green, and blue light, respectively. The micro-components 40 may be of any shape, including, but not limited to, spherical, cylindrical, aspherical, capillary shaped and capillary shaped with pinched regions also referred to as sausage shaped. In addition, it is contemplated that a micro-component 40 includes a micro-component placed or formed inside another structure, such as placing a spherical micro-component inside a cylindrical-shaped structure. In a color light-emitting display according to an embodiment of the present invention, each cylindrical-shaped structure holds micro-components configured to emit a single color of visible light or multiple colors arranged red, green, blue, or in some other suitable color arrangement.

In its most basic form, each micro-component 40 includes a shell 50 filled with a plasma-forming gas or gas mixture 45. Any suitable gas or gas mixture 45 capable of ionization may be used as the plasma-forming gas, including, but not limited to, krypton, xenon, argon, neon, oxygen, helium, mercury, and mixtures thereof. In fact, any noble gas could be used as the plasma-forming gas, including, but not limited to, noble gases mixed with cesium or mercury. Further, rare gas halide mixtures such as xenon chloride, xenon flouride and the like are also suitable plasma-forming gases. Rare gas halides are efficient radiators having radiating wavelengths over the approximate range of 190 nm to 350 nm., i.e., longer than that of pure xenon (147 to 170 nm). Using compounds such as xenon chloride that radiates near 310 nm results in an overall quantum efficiency gain, i.e., a factor of two or more, given by the mixture ratio. Still further, in another embodiment of the present invention, rare gas halide mixtures are also combined with other plasma-forming gases as listed above. As this description is not limiting, one skilled in the art would recognize other gasses or gas mixtures that could also be used. While a plasma-forming gas or gas mixture 45 is used in a preferred embodiment, any other material capable of providing luminescence is also contemplated, such as an electro-luminescent material, organic light-emitting diodes (OLEDs), or an electro-phoretic material.

There are a variety of coatings 300 (FIG. 2) and dopants that may be added to a micro-component 40 that also influence the performance and characteristics of the light-emitting display. The coatings 300 may be applied to the outside or inside of the shell 50, and may either partially or fully coat the shell 50. Alternatively, or in combination with the coatings and dopants that may be added to a micro-component 40, a variety of coatings 350 (FIG. 1) may be disposed on the inside of a socket 30. These coatings 350 include, but are not limited to, coatings used to convert UV light to visible light, coatings used as reflecting filters, and coatings used as band-gap filters.

The micro-component 40 structures of the present invention yield a more efficient utilization of both the time available and the energy necessary to excite one or more micro-components. In conventional displays, adjacent pixels are not completely or adequately isolated from one another, and the ultraviolet, visible, and infrared radiation and charged species (ions and/or electrons) generated in one pixel can either excite phosphors in communicating pixels or change charge accumulations that will affect the triggering of these pixels. The time required for this cross-talk from an operating pixel to affect communicating pixels is shorter than the duration of a typical "frame", that is, less that about a thirtieth of a second. The result is poor display performance such as a fuzzy picture. In order to prevent the effects of the radiation and/or charged species from one pixel affecting communicating pixels, the electrodes of the affected pixels need to be completely reset into a known charge state. The pixel is then turned back on or re-addressed. Typically, this occurs multiple times per frame, costing energy and frame time. Micro-component structures that eliminate the need to reset pixels multiple times during each frame save the energy required for such resetting, raising the display efficiency, and allow more time per frame for light emission, raising the display brightness. Resetting pixels multiple times per frame is not required in the sphere-shaped and sausage-capillary-shaped micro-component arrangements of the present invention. Because the gas within each micro-component is separated from gas in the other micro-components and the micro-components are separated by dielectric material, the radiation and charged species generated in the micro-components of the present invention do not affect adjacent micro-components during a frame. Therefore, each pixel does not have to be reset but instead can be addressed once and left running for an entire frame or, if desired, for multiple frames. The light-emitting display of the present invention provides the benefits of getting more lumens out of a display, saving the power and frame time associated with resetting each pixel multiple times per frame, and preventing the generation of excess visible radiation associated with resetting pixels that reduces the display contrast.

As is best shown in FIGS. 3A–3J, a cavity 55 formed within and/or on the first substrate 10 provides the basic socket 30 structure. The cavity 55 may be any shape and size. Suitable shapes for the cavity 55 include, but are not limited to, a cube 100, a cone 110, a conical frustum 120, a paraboloid 130, spherical 140, cylindrical 150, a pyramid 160, a pyramidal frustum 170, a parallelepiped 180, or a prism 190.

Figure 4:
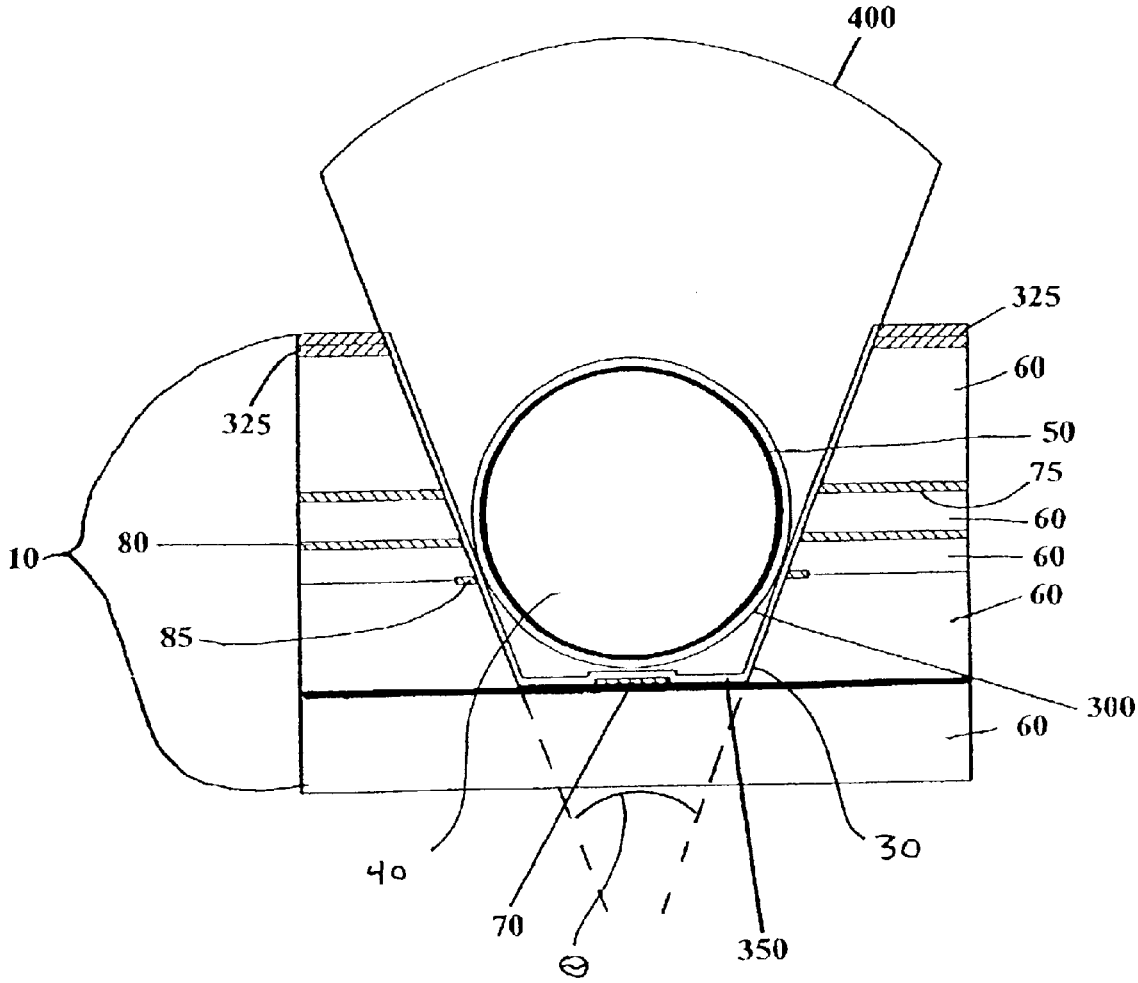
FIG. 4 shows the socket structure from a light-emitting display of an embodiment of the present invention with a narrower field of view.
Figure 5:
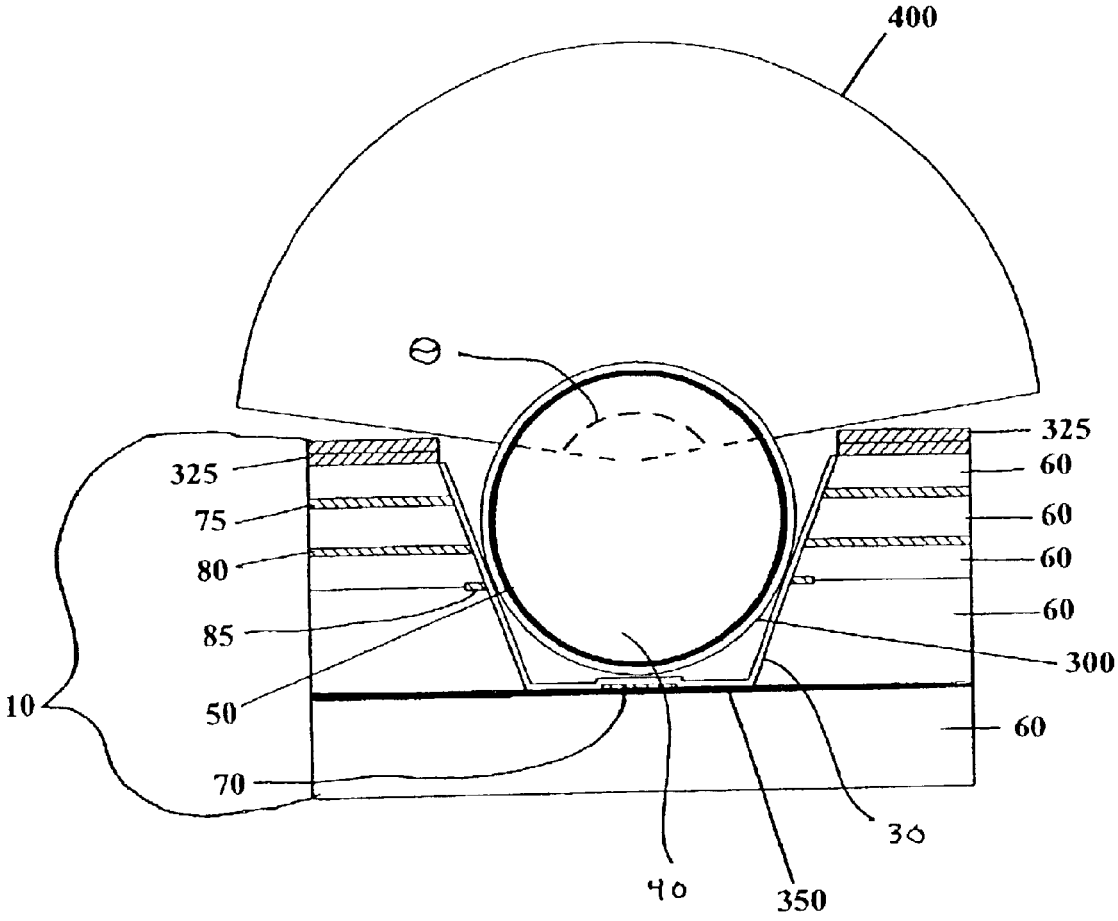
FIG. 5 shows the socket structure from a light-emitting display of an embodiment of the present invention with a wider field of view.

Referring to FIGS. 4 and 5, the size and shape of the socket 30 influence the performance and characteristics of the light-emitting display and are selected to optimize the display's efficiency of operation. In addition, socket geometry may be selected based on the shape and size of the micro-component to optimize the surface contact between the micro-component and the socket and/or to ensure connectivity of the micro-component and any electrodes disposed within the socket. Further, the size and shape of the sockets 30 may be chosen to optimize photon generation and provide increased luminosity and radiation transport efficiency. For example, the size and shape may be chosen to provide a field of view 400 with a specific angle θ, such that a micro-component 40 disposed in a deep socket 30 may provide more collimated light and hence a narrower viewing angle θ (FIG. 4), while a micro-component 40 disposed in a shallow socket 30 may provide a wider viewing angle θ (FIG. 5). That is to say, the cavity may be sized, for example, so that its depth subsumes a micro-component deposited in a socket, or it may be made shallow so that a micro-component is only partially disposed within a socket.

As illustrated, for example, in FIGS. 3A–3J, in one embodiment of the light-emitting display, a cavity 55 is formed, or patterned, in a substrate 10 to create a basic socket shape. The cavity may be formed in any suitable shape and size by any combination of physically, mechanically, thermally, electrically, optically, or chemically deforming the substrate. Disposed proximate to, and/or in, each socket may be one or more layers of a variety of enhancement materials 325. The enhancement materials 325 include, but are not limited to, anti-glare coatings, touch sensitive surfaces, contrast enhancement coatings, protective coatings, transistors, integrated-circuits, semiconductor devices, inductors, capacitors, resistors, control electronics, drive electronics, diodes, pulse-forming networks, pulse compressors, pulse transformers, and tuned-circuits.

In another embodiment of the light-emitting display as illustrated in FIGS. 4–5, a socket 30 is formed by disposing a plurality of material layers 60 to form a first substrate 10, disposing at least one electrode either on or within the material layers, and selectively removing a portion of the material layers 60 to create a cavity. The material layers 60 include any combination, in whole or in part, of dielectric materials, metals, and enhancement materials 325. The enhancement materials 325 include, but are not limited to, anti-glare coatings, touch sensitive surfaces, contrast enhancement coatings, protective coatings, transistors, integrated-circuits, semiconductor devices, inductors, capacitors, resistors, control electronics, drive electronics, diodes, pulse-forming networks, pulse compressors, pulse transformers, and tuned-circuits. The placement of the material layers 60 may be accomplished by any transfer process, photolithography, xerographic-type processes, plasma deposition, sputtering, laser deposition, chemical deposition, vapor deposition, or deposition using ink jet technology. One of general skill in the art will recognize other appropriate methods of disposing a plurality of material layers. The socket 30 may be formed in the material layers 60 by a variety of methods including, but not limited to, wet or dry etching, photolithography, laser heat treatment, thermal form, mechanical punch, embossing, stamping-out, drilling, electroforming or by dimpling.

Figure 9:
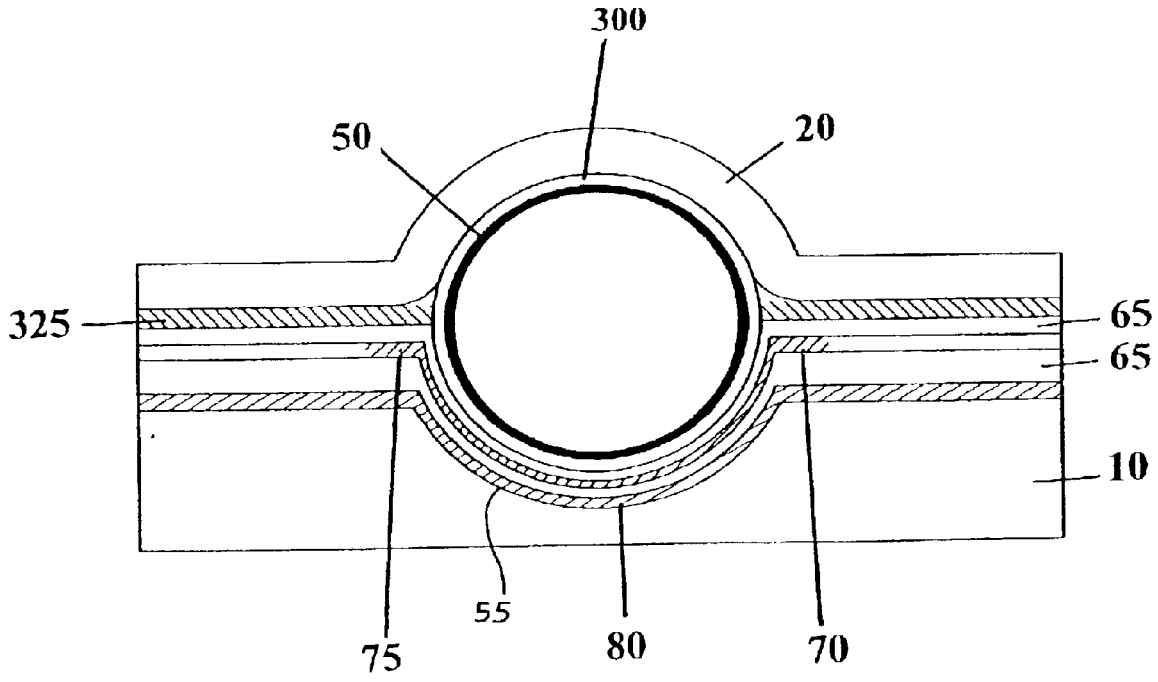
FIG. 9 depicts a portion of a light-emitting display showing the basic structure of a socket formed from patterning a substrate and then disposing a plurality of material layers on the substrate so that the material layers conform to the shape of the cavity with the electrodes having a co-planar configuration.
Figure 10:
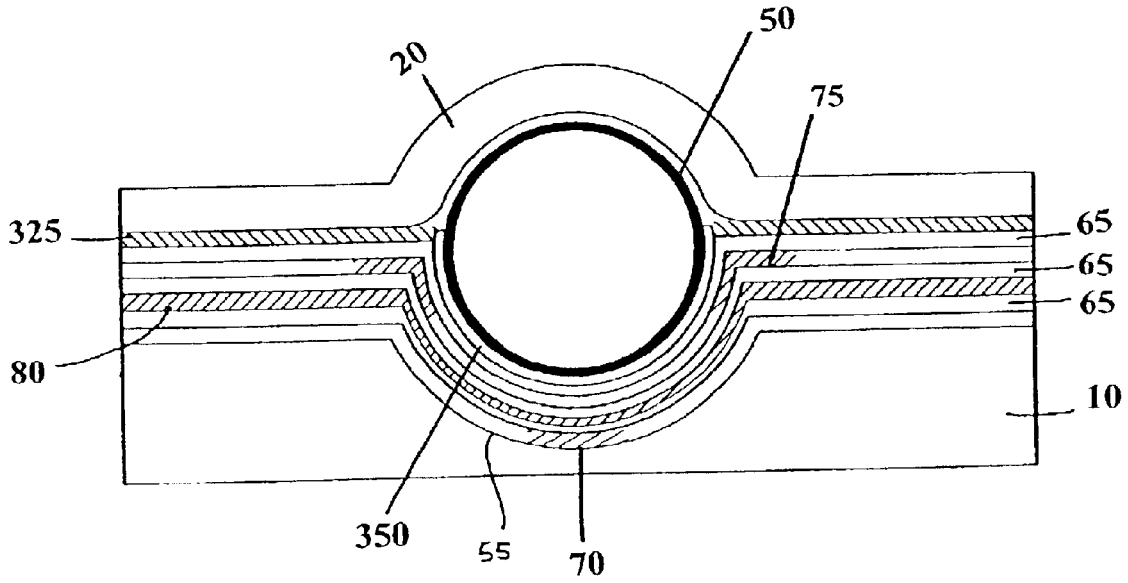
FIG. 10 depicts a portion of a light-emitting display showing the basic structure of a socket formed from patterning a substrate and then disposing a plurality of material layers on the substrate so that the material layers conform to the shape of the cavity with the electrodes having a mid-plane configuration.
Figure 11:
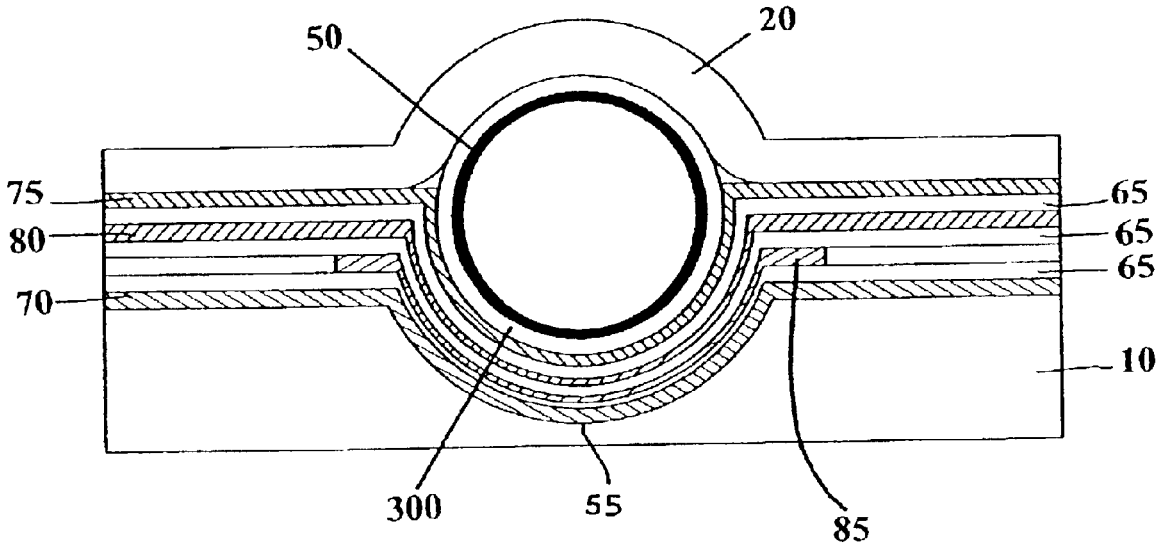
FIG. 11 depicts a portion of a light-emitting display showing the basic structure of a socket formed from patterning a substrate and then disposing a plurality of material layers on the substrate so that the material layers conform to the shape of the cavity with the electrodes having an configuration with two sustain and two address electrodes, where the address electrodes are between the two sustain electrodes.

In yet another embodiment of the light-emitting display as shown for example in FIGS. 9–11, a socket 30 is formed by patterning a cavity 55 in a first substrate 10, disposing a plurality of material layers 65 on the first substrate 10 so that the material layers 65 conform to the cavity 55, and disposing at least one electrode on the first substrate 10, within the material layers 65, or any combination thereof. The cavity may be formed in any suitable shape and size by any combination of physically, mechanically, thermally, electrically, optically, or chemically deforming the substrate. The material layers 65 include any combination, in whole or in part, of dielectric materials, metals, and enhancement materials 325. The enhancement materials 325 include, but are not limited to, anti-glare coatings, touch sensitive surfaces, contrast enhancement coatings, protective coatings, transistors, integrated-circuits, semiconductor devices, inductors, capacitors, resistors, control electronics, drive electronics, diodes, pulse-forming networks, pulse compressors, pulse transformers, and tuned-circuits. The placement of the material layers 65 may be accomplished by any transfer process, photolithography, xerographic-type processes, plasma deposition, sputtering, laser deposition, chemical deposition, vapor deposition, or deposition using ink jet technology. One of general skill in the art will recognize other appropriate methods of disposing a plurality of material layers on a substrate.

Figure 12:
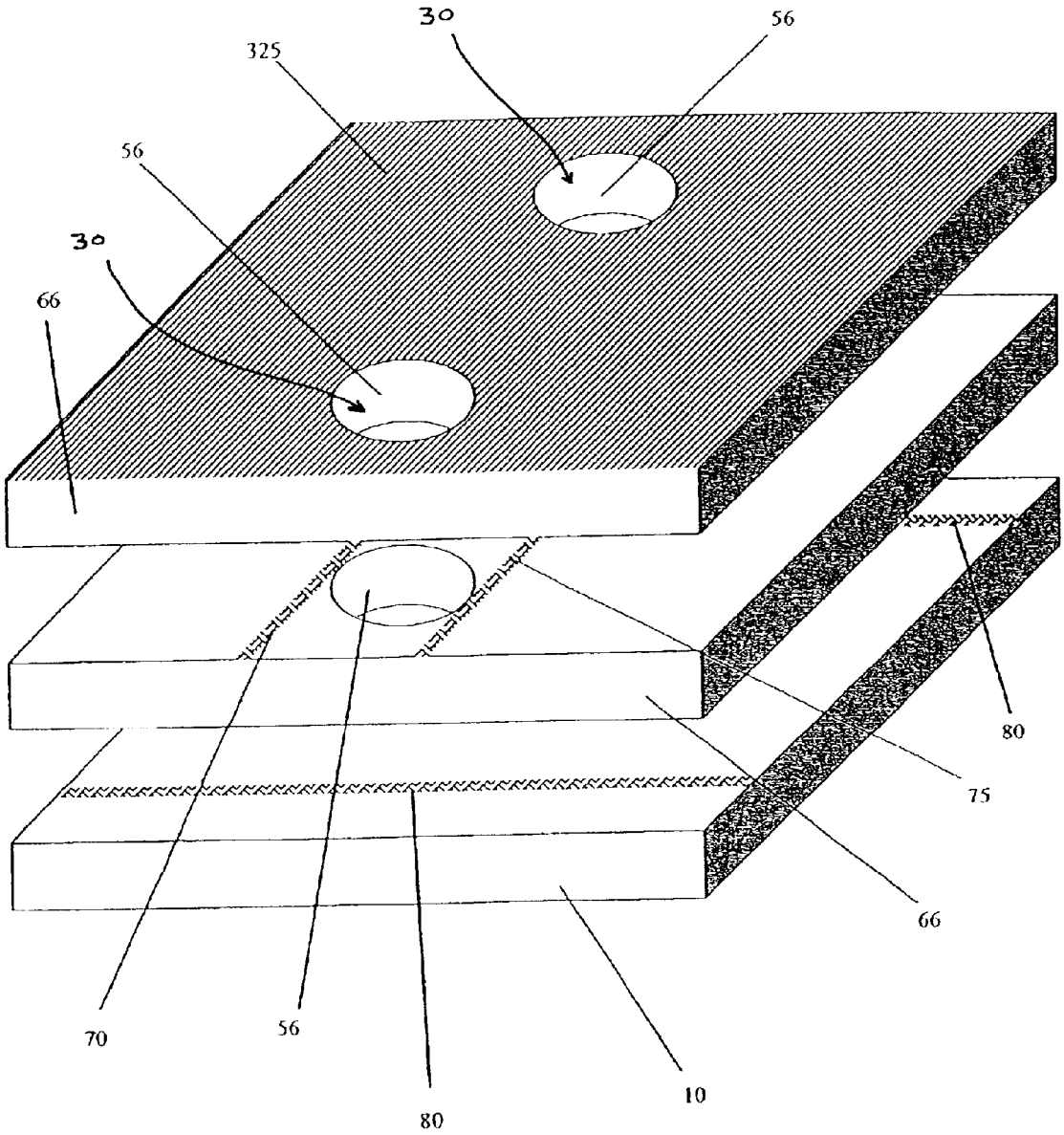
FIG. 12 shows an exploded view of a portion of a light-emitting display showing the basic structure of a socket formed by disposing a plurality of material layers with aligned apertures on a substrate with the electrodes having a co-planar configuration.
Figure 13:
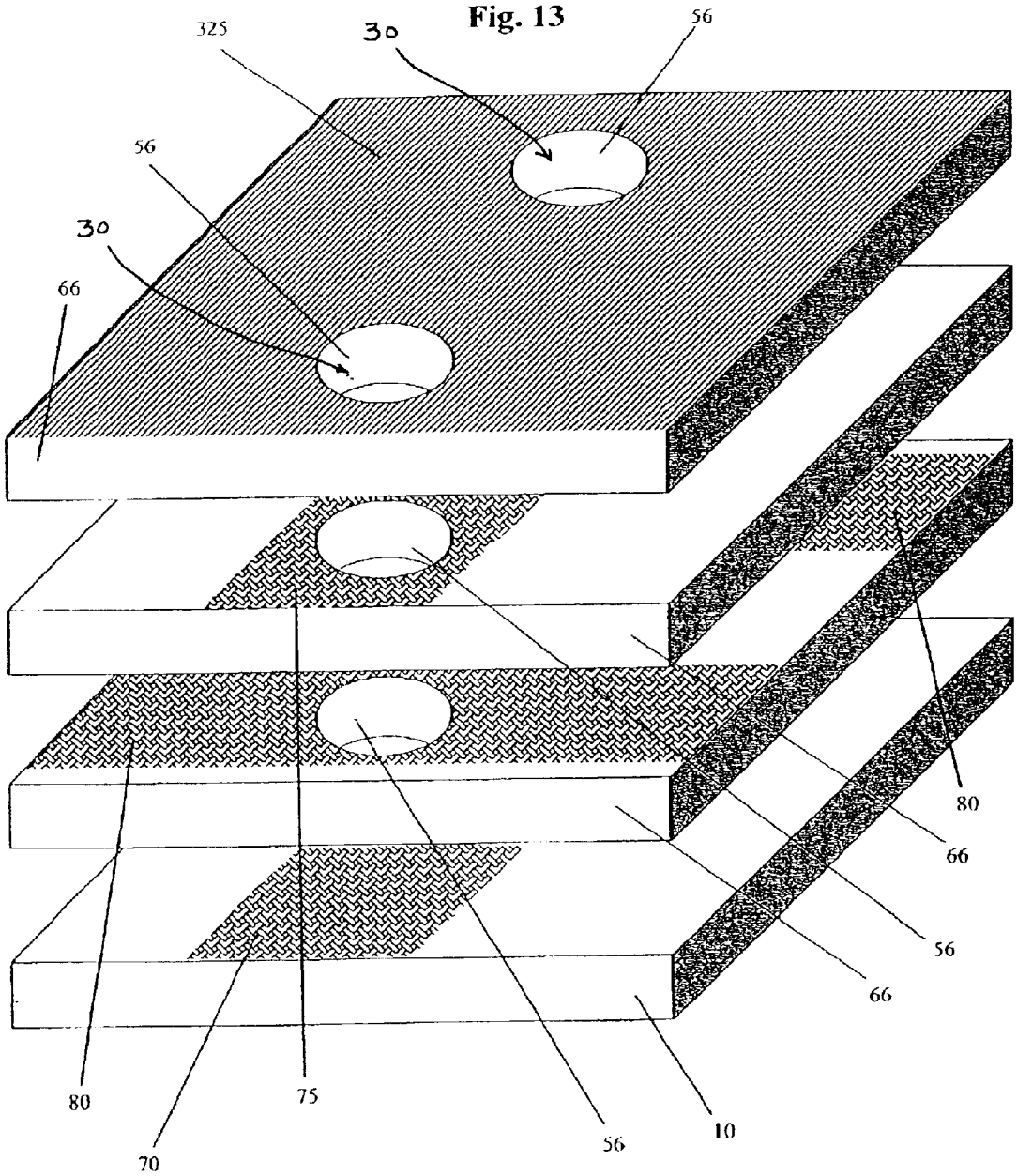
FIG. 13 shows an exploded view of a portion of a light-emitting display showing the basic structure of a socket formed by disposing a plurality of material layers with aligned apertures on a substrate with the electrodes having a mid-plane configuration.
Figure 14:
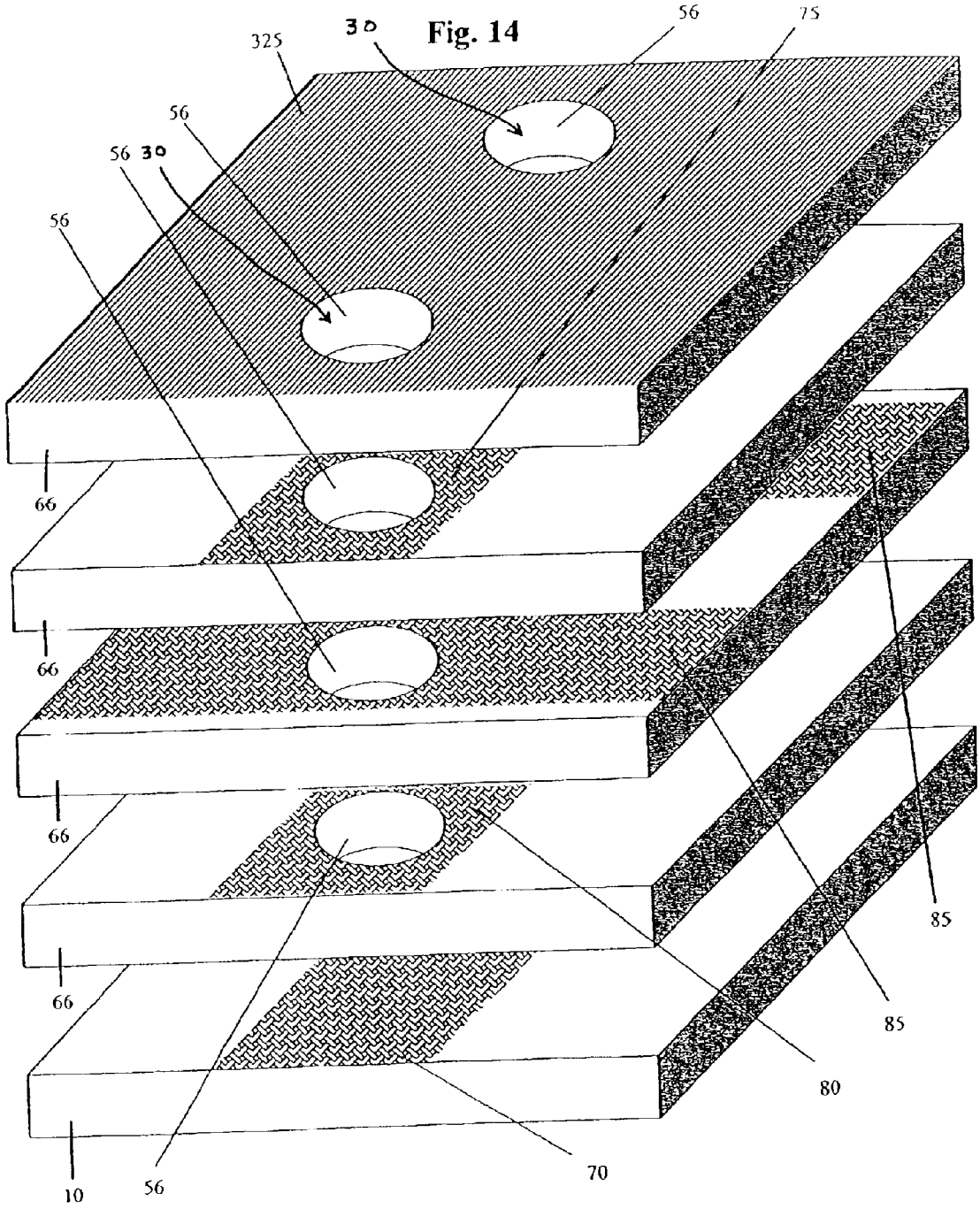
FIG. 14 shows an exploded view of a portion of a light-emitting display showing the basic structure of a socket formed by disposing a plurality of material layers with aligned apertures on a substrate with electrodes having a configuration with two sustain and two address electrodes, where the address electrodes are between the two sustain electrodes.

In an embodiment for making the light-emitting display including a plurality of sockets, as illustrated, for example, in FIGS. 12–14, a socket 30 is formed by disposing a plurality of material layers 66 on a first substrate 10 and disposing at least one electrode on the first substrate 10, within the material layers 66, or any combination thereof. Each of the material layers includes a preformed aperture 56 that extends through the entire material layer. The apertures may be of the same size or may be of different sizes. The plurality of material layers 66 are disposed on the first substrate with the apertures in alignment thereby forming the socket 30. The material layers 66 include any combination, in whole or in part, of dielectric materials, metals, and enhancement materials 325. The enhancement materials 325 include, but are not limited to, anti-glare coatings, touch sensitive surfaces, contrast enhancement coatings, protective coatings, transistors, integrated-circuits, semiconductor devices, inductors, capacitors, resistors, diodes, control electronics, drive electronics, pulse-forming networks, pulse compressors, pulse transformers, and tuned-circuits. The placement of the material layers 66 may be accomplished by any transfer process, photolithography, xerographic-type processes, plasma deposition, sputtering, laser deposition, chemical deposition, vapor deposition, or deposition using ink jet technology. One of general skill in the art will recognize other appropriate methods of disposing a plurality of material layers on a substrate.

In each of the above embodiments describing methods of making a socket in a light-emitting display, disposed in, or proximate to, each socket may be at least one enhancement material. As stated above, suitable enhancement materials 325 include, but are not limited to, anti-glare coatings, touch sensitive surfaces, contrast enhancement coatings, protective coatings, transistors, integrated-circuits, semiconductor devices, inductors, capacitors, resistors, control electronics, drive electronics, diodes, pulse-forming networks, pulse compressors, pulse transformers, tuned-circuits, and combinations thereof. In a preferred embodiment of the present invention the enhancement materials may be placed in, or proximate to, each socket by transfer processes, photolithography, sputtering, laser deposition, chemical deposition, vapor deposition, deposition using ink jet technology, mechanical means or combinations thereof.

In another embodiment of the present invention, the method for making the light-emitting display includes disposing at least one electrical enhancement (e.g. transistors, integrated-circuits, semiconductor devices, inductors, capacitors, resistors, control electronics, drive electronics, diodes, pulse-forming networks, pulse compressors, pulse transformers, tuned-circuits, and combinations thereof), in, or proximate to, each socket by suspending the at least one electrical enhancement in a liquid and flowing the liquid across the first substrate. As the liquid flows across the substrate the at least one electrical enhancement will settle in each socket. Alternate substances or means may also be used to move the electrical enhancements across the substrate. Air can be used to move the electrical enhancements across the substrate. In an embodiment of the present invention the socket is of a corresponding shape to the at least one electrical enhancement such that the at least one electrical enhancement self-aligns with the socket.

The electrical enhancements may be used in the light-emitting display for a number of purposes including, but not limited to, lowering the voltage necessary to ionize the plasma-forming gas in a micro-component, lowering the voltage required to sustain/erase the ionization charge in a micro-component, increasing the luminosity and/or radiation transport efficiency of a micro-component, augmenting the frequency at which a micro-component is lit and combinations thereof. In addition, the electrical enhancements may be used in conjunction with the light-emitting display driving circuitry to alter the power requirements necessary to drive the light-emitting display. For example, a tuned-circuit may be used in conjunction with the driving circuitry to allow a DC power source to power an AC-type light-emitting display. In one embodiment, a controller is provided that is connected to the electrical enhancements and is capable of controlling their operation. Having the ability to individually control the electrical enhancements at the pixel or subpixel level provides a means by which the characteristics of individual micro-components may be altered or corrected after fabrication of the light-emitting display. These characteristics include, but are not limited to, the luminosity and the frequency at which a micro-component is lit. One skilled in the art will recognize other uses for electrical enhancements disposed in, or proximate to, each socket in a light-emitting display.

The electrical potential necessary to energize a micro-component 40 is supplied through at least two electrodes. The electrodes may be disposed in the light-emitting display using any technique known to one skilled in the art including, but not limited to, any transfer process, photolithography, xerographic-type processes, plasma deposition, sputtering, laser deposition, chemical deposition, vapor deposition, deposition using ink jet technology, or mechanical means. In a general embodiment of the present invention, a light-emitting display includes a plurality of electrodes, wherein at least two electrodes are adhered to the first substrate, the second substrate or any combination thereof and wherein the electrodes are arranged so that voltage applied to the electrodes causes one or more micro-components to emit radiation. In another general embodiment, a light-emitting display includes a plurality of electrodes, wherein at least two electrodes are arranged so that the voltage supplied to the electrodes causes one or more micro-components to emit radiation throughout the field of view of the light-emitting display without crossing or intersecting either of the electrodes.

Referring to FIGS. 1 and 2, in one embodiment where the sockets 30 each include a cavity patterned in the first substrate 10, at least two electrodes may be disposed on the first substrate 10, the second substrate 20, or any combination thereof. The electrodes can be placed in the substrates either before the cavity is formed or after the cavity is formed. A sustain electrode 70 is adhered on the second substrate 20 and an address or trigger electrode 80 is adhered on the first substrate 10. In a preferred embodiment, at least one electrode adhered to the first substrate 10 is at least partially disposed within the socket.

Figure 6A:
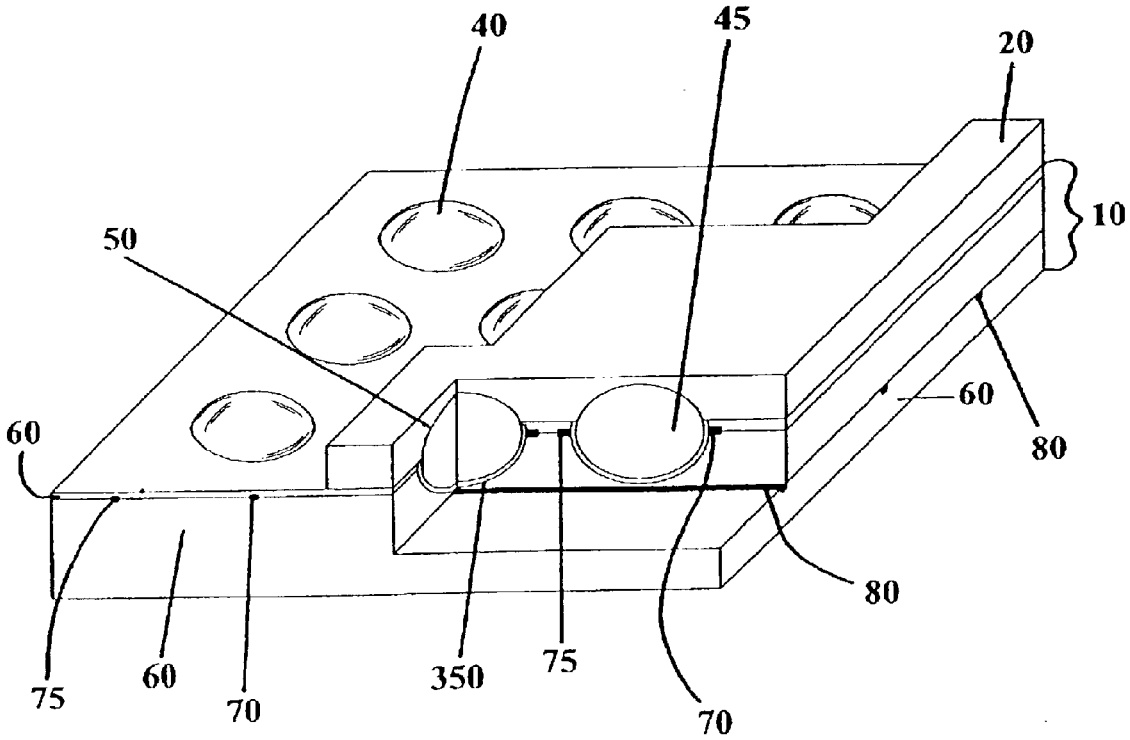
FIG. 6A depicts a portion of a light-emitting display showing the basic structure of a socket formed from disposing a plurality of material layers and then selectively removing a portion of the material layers with the electrodes having a co-planar configuration.
Figure 6B:
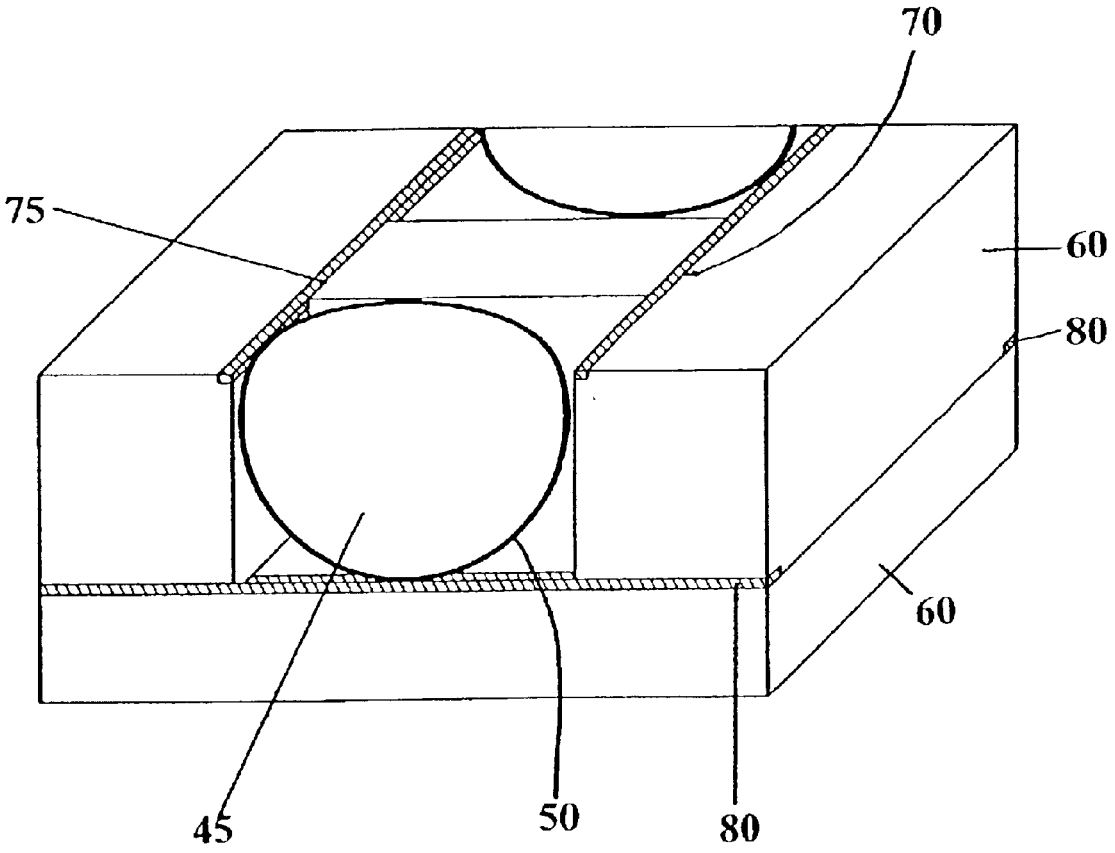
FIG. 6B is a cut-away of FIG. 6A showing in more detail the co-planar sustaining electrodes.
Figure 7A:
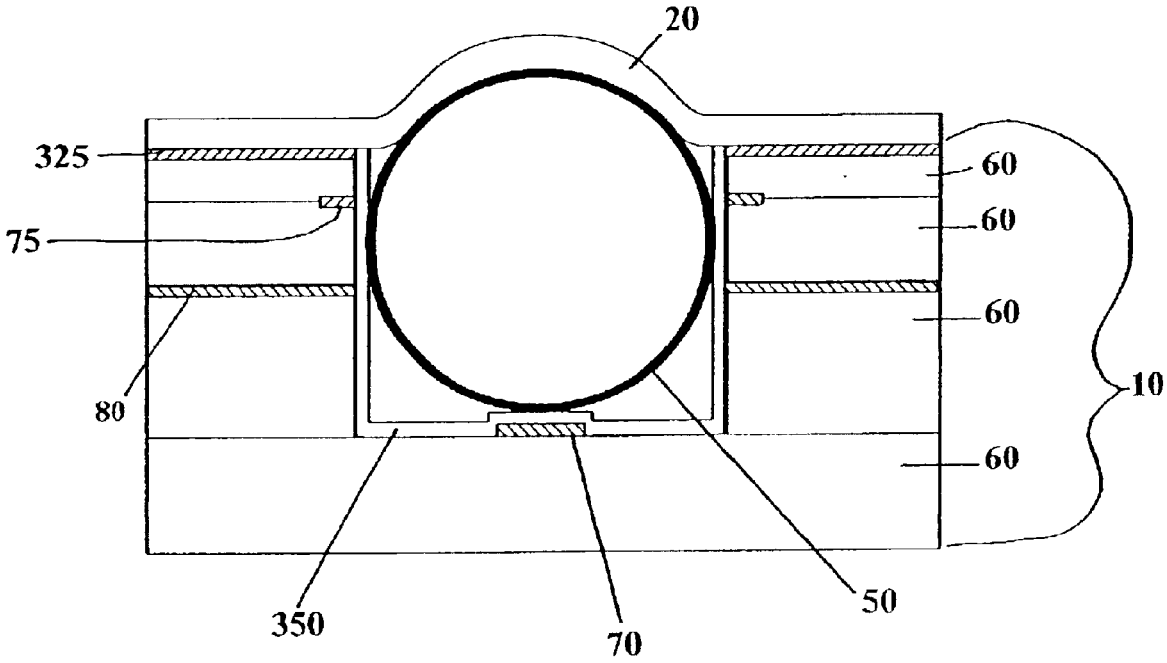
FIG. 7A depicts a portion of a light-emitting display showing the basic structure of a socket formed from disposing a plurality of material layers and then selectively removing a portion of the material layers with the electrodes having a mid-plane configuration.
Figure 7B:
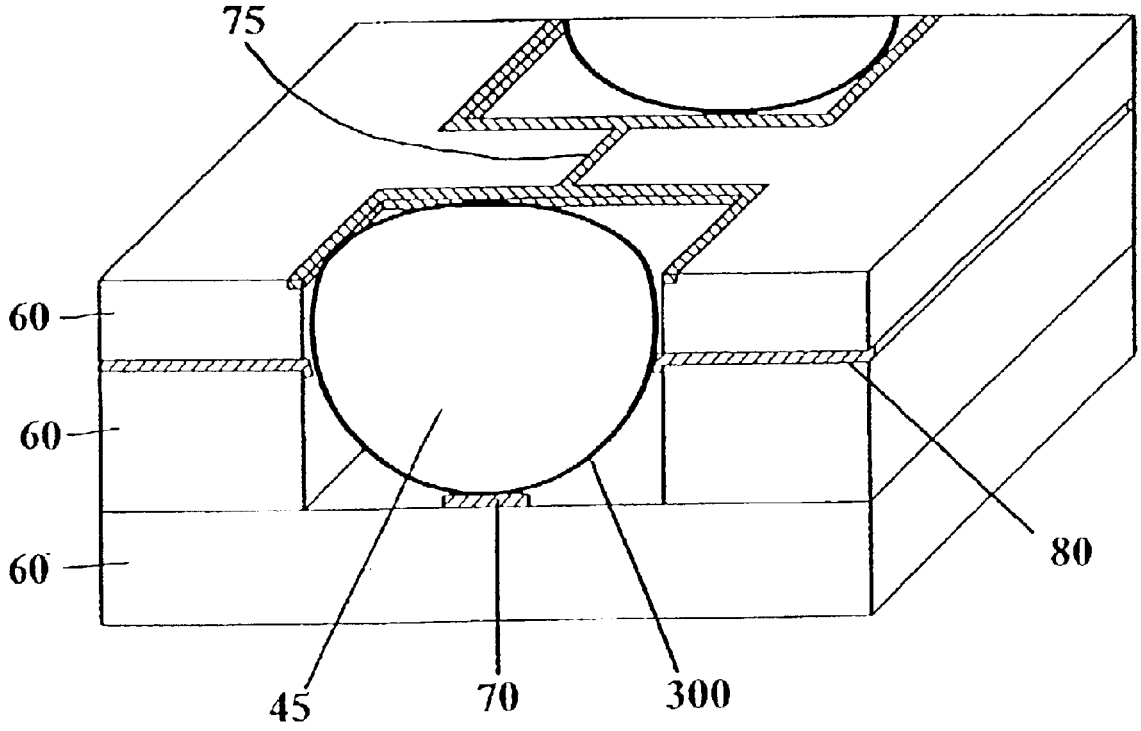
FIG. 7B is a cut-away of FIG. 7A showing in more detail the uppermost sustain electrode.
Figure 8:
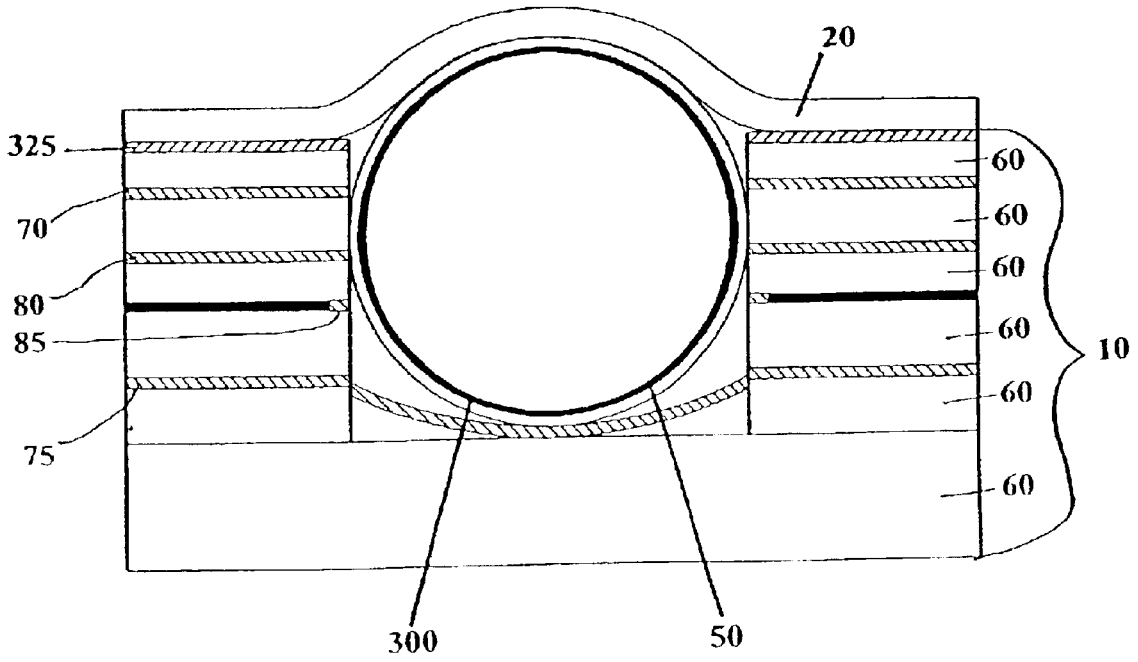
FIG. 8 depicts a portion of a light-emitting display showing the basic structure of a socket formed from disposing a plurality of material layers and then selectively removing a portion of the material layers with the electrodes having an configuration with two sustain and two address electrodes, where the address electrodes are between the two sustain electrodes.

In an embodiment where the first substrate 10 includes a plurality of material layers 60 and the sockets 30 are formed within the material,layers at least two electrodes may be disposed on the first substrate 10, disposed within the material layers 60, disposed on the second substrate 20, or any combination thereof. As is shown, for example, in FIG. 6A, a first address electrode 80 is disposed within the material layers 60, a first sustain electrode 70 is disposed within the material layers 60, and a second sustain electrode 75 is disposed within the material layers 60, such that the first sustain electrode and the second sustain electrode are in a co-planar configuration. FIG. 6B is a cut-away of FIG. 6A showing the arrangement of the co-planar sustain electrodes 70 and 75. In another embodiment, as shown in FIG. 7A, the second sustain electrode 75 is disposed on the first substrate 10, a first address electrode 80 is disposed within the material layers 60, and the first sustain electrode 70 is disposed within the material layers 60, such that the first address electrode is located between the first sustain electrode and the second sustain electrode in a mid-plane configuration. FIG. 7B is a cut-away of FIG. 7A showing the first sustain electrode 70. In this mid-plane configuration, the sustain function will be performed by the two sustain electrodes much like in the co-planar configuration, and the address function will be performed between at least one of the sustain electrodes and the address electrode. Energizing a micro-component with this arrangement of electrodes should produce increased luminosity. In a preferred embodiment of the present invention as is shown in FIG. 8, a first sustain electrode 70 is disposed within the material layers 60, a first address electrode 80 is disposed within the material layers 60, a second address electrode 85 is disposed within the material layers 60, and a second sustain electrode 75 is disposed within the material layers 60, such that the first address electrode and the second address electrode are located between the first sustain electrode and the second sustain electrode. This configuration completely separates the addressing or triggering functions from the sustain electrodes. This arrangement should provide a simpler and cheaper means of addressing, sustain and erasing, because complicated switching means will not be required since different voltage sources may be used for the sustain and address electrodes. In addition, by separating the sustain and address electrodes and using different voltage sources to provide the address and sustain functions, different types of voltage sources may be used to provide the address or sustain functions. For example, a lower voltage source can be used to address the micro-components.

In the embodiments as shown in FIGS. 9–11 where a cavity 55 is patterned in the first substrate 10 and a plurality of material layers 65 are disposed on the first substrate 10 so that the material layers conform to the cavity 55. At least two electrodes may be disposed on the first substrate 10, at least partially disposed within the material layers 65, disposed on the second substrate 20, or any combination thereof. Electrodes formed on the first substrate may be placed either before the cavity is patterned or after the cavity is patterned. In one embodiment, as shown in FIG. 9, a first address electrode 80 is disposed on the first substrate 10, a first sustain electrode 70 is disposed within the material layers 65, and a second sustain electrode 75 is disposed within the material layers 65, such that the first sustain electrode and the second sustain electrode are in a co-planar configuration. In another embodiment, as shown in FIG. 10, the second sustain electrode 75 is disposed on the first substrate 10, a first address electrode 80 is disposed within the material layers 65, and the first sustain electrode 70 is disposed within the material layers 65, such that the first address electrode is located between the first sustain electrode and the second sustain electrode in a mid-plane configuration. In this mid-plane configuration, the sustain function will be performed by the two sustain electrodes much like in the co-planar configuration, and the address function will be performed between at least one of the sustain electrodes and the address electrode. Energizing a micro-component with this arrangement of electrodes should produce increased luminosity. As is shown in FIG. 11, in a preferred embodiment of the present invention, the second sustain electrode 75 is disposed on the first substrate 10, a first address electrode 80 is disposed within the material layers 65, a second address electrode 85 is disposed within the material layers 65, and the first sustain electrode 70 is disposed within the material layers 65, such that the first address electrode and the second address electrode are located between the first sustain electrode and the second sustain electrode. This configuration separates the addressing function from the sustain electrodes. This arrangement should facilitate simpler and cheaper methods of addressing, sustaining and erasing, because complicated switching methods will not be required since different voltage sources can be used for the sustain and address electrodes. By separating the sustain and address electrodes and using different voltage sources to address and sustain the micro-components, a lower or different type of voltage source may be used to provide the address or sustain functions. For example, a lower voltage source can be used to address the micro-components.

In the embodiments as illustrated in FIGS. 12–14, where a plurality of material layers 66 with aligned apertures 56 are disposed on a first substrate 10 thereby creating cavities 55, at least two electrodes may be disposed on the first substrate 10, at least partially disposed within the material layers 65, disposed on the second substrate 20, or any combination thereof. In one embodiment, as shown in FIG. 12, a first address electrode 80 is disposed on the first substrate 10, a first sustain electrode 70 is disposed within the material layers 66, and a second sustain electrode 75 is disposed within the material layers 66, such that the first sustain electrode and the second sustain electrode are in a co-planar configuration. In another embodiment, as shown in FIG. 13, a first sustain electrode 70 is disposed on the first substrate 10, a first address electrode 80 is disposed within the material layers 66, and a second sustain electrode 75 is disposed within the material layers 66, such that the first address electrode is located between the first sustain electrode and the second sustain electrode in a mid-plane configuration. In this mid-plane addressing or triggering configuration, the sustain function is performed by the two sustain electrodes as in the co-planar configuration, and the address or trigger function is performed between at least one of the sustain electrodes and the address electrode. Energizing a micro-component using this arrangement of electrodes should produce increased luminosity. In a preferred embodiment of the present invention as shown in FIG. 14, a first sustain electrode 70 is disposed on the first substrate 10, a first address electrode 80 is disposed within the material layers 66, a second address electrode 85 is disposed within the material layers 66, and a second sustain electrode 75 is disposed within the material layers 66, such that the first address electrode and the second address electrode are located between the first sustain electrode and the second sustain electrode. This configuration separates the addressing function from the sustain electrodes. This arrangement should provide a simpler and less expensive means of addressing, sustaining and erasing selected micro-components, because complicated switching means are not required as different voltage sources can be used for the sustain and address electrodes. By separating the sustain and address electrodes and using different voltage sources to address and sustain the micro-components a lower or different type of voltage source may be used to provide the address or sustain functions. For example, a lower voltage source can be used to address the micro-components.

The present invention is also directed to devices and methods for addressing selected pixels, subpixels or micro-components in the light emitting or plasma display. The devices and methods employ arrangements and methods of operation of light-emitting displays that increase the operating efficiency of these displays.

Figure 15:
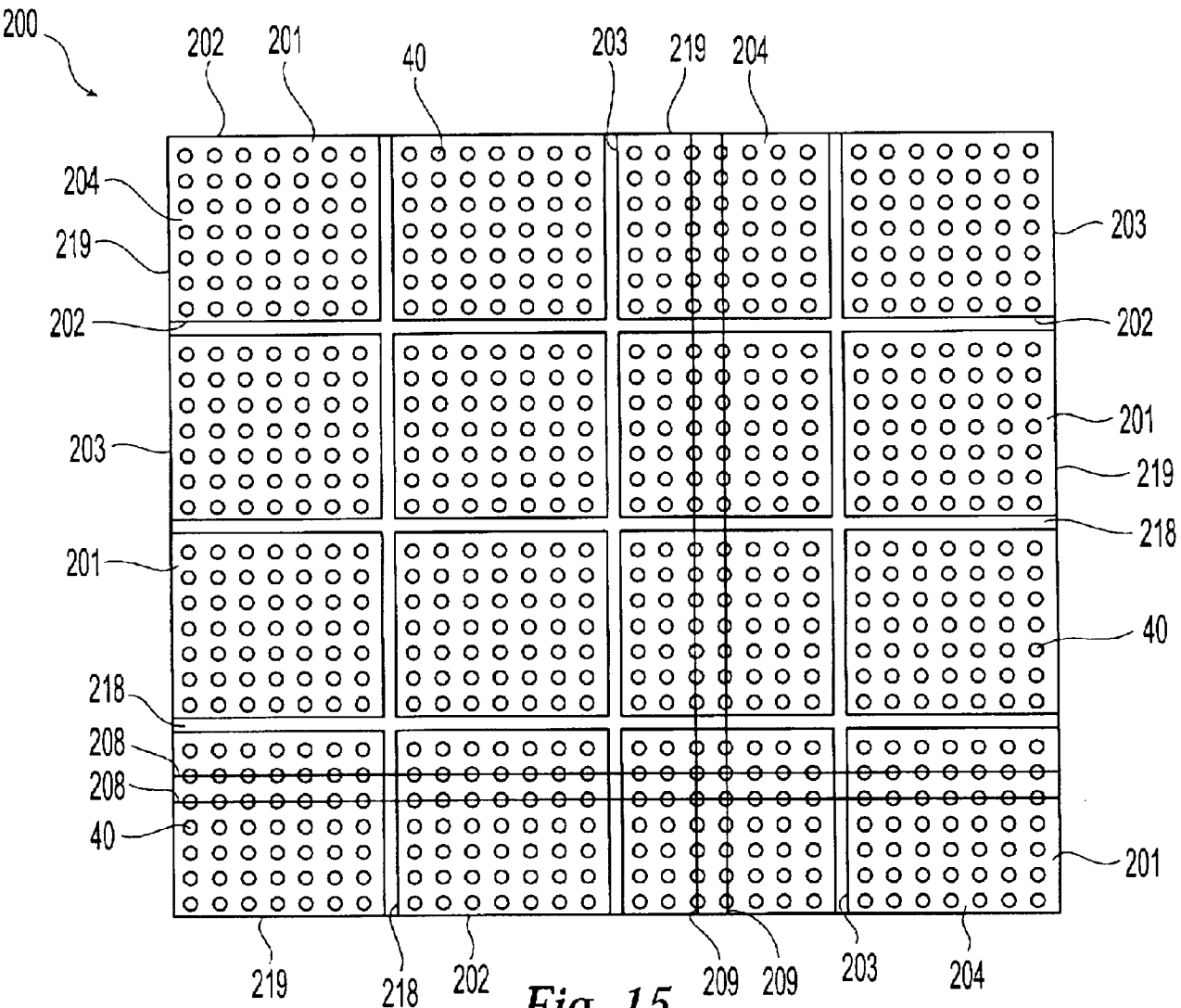
FIG. 15 is a schematic representation from the front of a light-emitting display of the present invention constructed from a plurality of panels.

Referring to FIG. 15, to provide for improved addressing of micro-components, the light-emitting display 200 is broken down, either physically or logically into a plurality of electrically interconnected panels 201. A light emitting display can contain one or more of these panels 200. Each panel 201 contains an array of micro-components or pixels such as a 1×1, 10×10, or 100×100 micro-component 40 or pixel grid or array.

Figure 16:
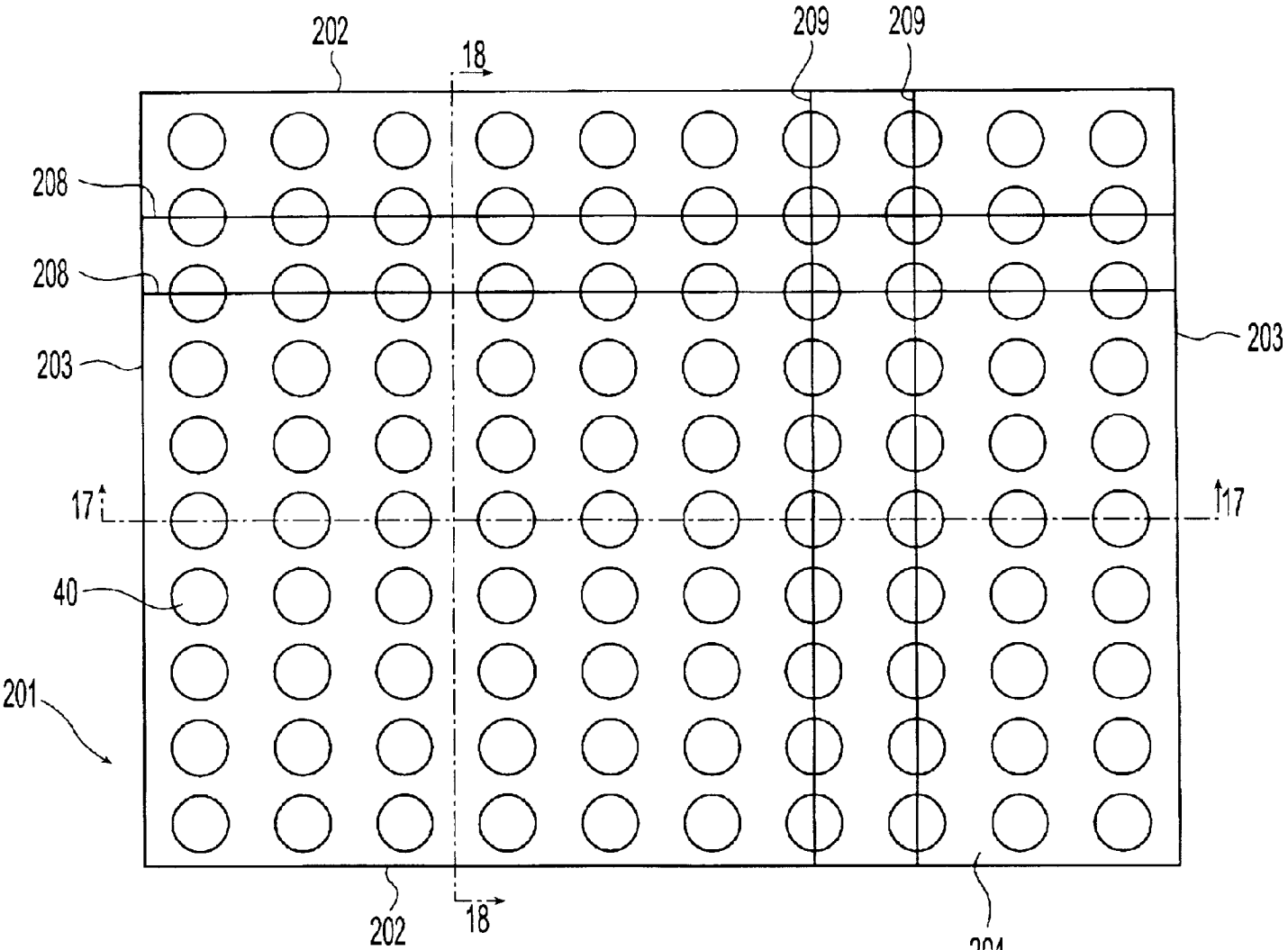
FIG. 16 is a schematic representation of one panel thereof.
Figure 17:
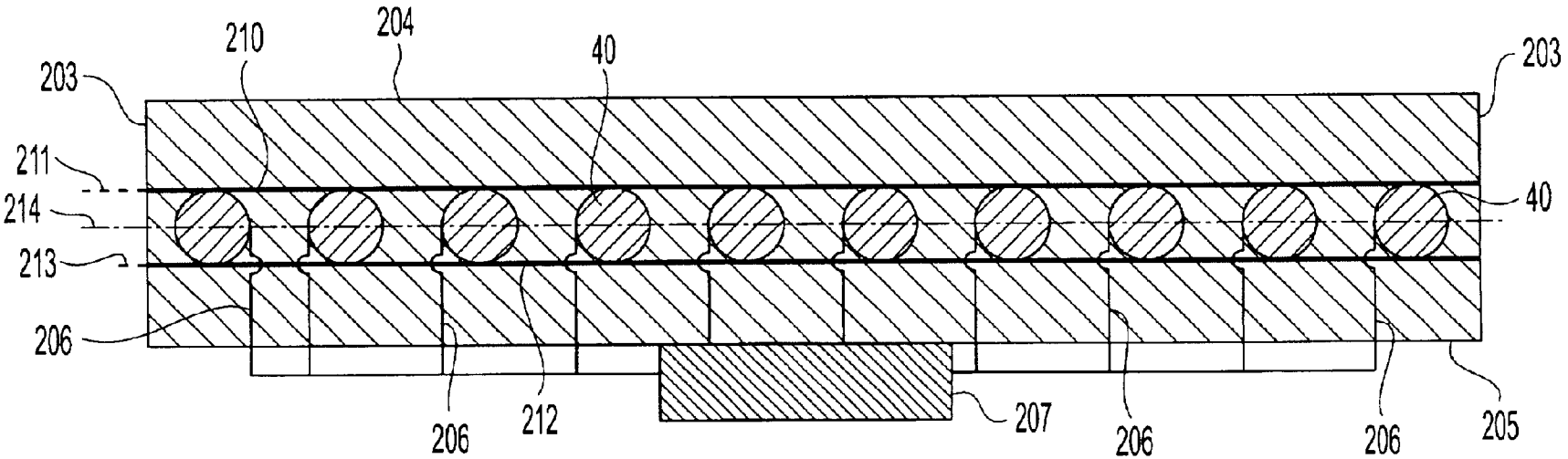
FIG. 17 is a view line 17—17 of FIG. 16.

As is best shown in FIGS. 15–17 each panel 201 includes first and second sets of opposing edges 202, 203, a front 204 and a back 205 opposite the front 204. Both the front 204 and the back 205 of the panel 201 are bound by the first and second sets of opposing edges 202, 203. The front 204 contains a plurality of the micro-components 40 of the present invention which are capable of emitting radiation when exposed to a triggering voltage. Preferably, the micro-components 40 emit ultra violet radiation. The voltages necessary to address, trigger, and sustain selected micro-components 40 in the panels 201 can be supplied by the various arrangements of the electrodes, substrates, and dielectrics of the present invention.

As is best shown in FIG. 17, at least one triggering electrode 206 is provided in the panel 201 and is electrically coupled to at least one of the micro-components 40. In this embodiment, the triggering electrode 206 is passed through the panel 201 to the back 205 of the panel 201. At least one voltage source 207 is located at the back 205 of the panel 201 between the first and second sets of edges 202, 203 and is electrically coupled to the triggering electrode 206. Suitable voltage sources 207 are capable of supplying a triggering voltage to the micro-components 40 through the triggering electrode 206. Alternatively, the panel 201 includes a plurality of triggering electrodes 206 electrically coupled to the plurality of micro-components 40. In addition, a plurality of voltage sources 207 can be electrically coupled to the plurality of triggering electrodes 206.

As is best illustrated in FIG. 16 the micro-components 40 within each panel 201 are addressed using row and column type addressing devices or drivers. Therefore, the plurality of micro-components 40 in each panel 201 are disposed in a common plane and are arranged in that plane in a grid pattern having a plurality of parallel rows 208 and a plurality of parallel columns 209 arranged orthogonal to the plurality of rows 208. Preferably, each micro-component 40 is at a point of intersection of a row 208 and column 209 or where the rows 208 and columns 209 cross each other.

Each panel 201 also includes a plurality of parallel sustain electrodes electrically coupled to the micro-components. Preferably, the sustain electrodes are arranged parallel to one of the rows and columns. The sustain electrodes can be disposed in various layers or locations throughout the panel 201 and the substrates or layers that make up each panel 201. In a preferred embodiment as is shown in FIG. 17, the sustain electrodes are divided and arranged into a first set of sustain electrodes 210 disposed in a first plane 211 parallel to the front 204 and back 205 and a second set of sustain electrodes 212 disposed in a second plane 213 spaced from the first plane 211 and parallel thereto.

The triggering electrodes 206 for delivering the necessary triggering voltage to the micro-components 40 are electrically coupled to each micro-component 40 at a third plane 214 parallel to the first plane 211 and located between the first plane 211 and the second plane 213. Alternatively, the triggering electrodes 206 are provided as a plurality of parallel triggering electrodes 206 electrically coupled to the plurality of micro-components 40. In one embodiment, shown in FIG. 18 and referred to as a triode embodiment because it contains two sustain and one triggering electrode for a total of three electrodes in contact with each micro-component 40, the triggering electrodes 206 are arranged to cross, although not necessarily intersect or contact, the first and second sets of sustain electrodes perpendicularly and are disposed in the third plane 214 parallel to the first plane 211 and located between the first and second planes. Other triode arrangements are also possible as shown for example in FIG. 13.

Figure 19:
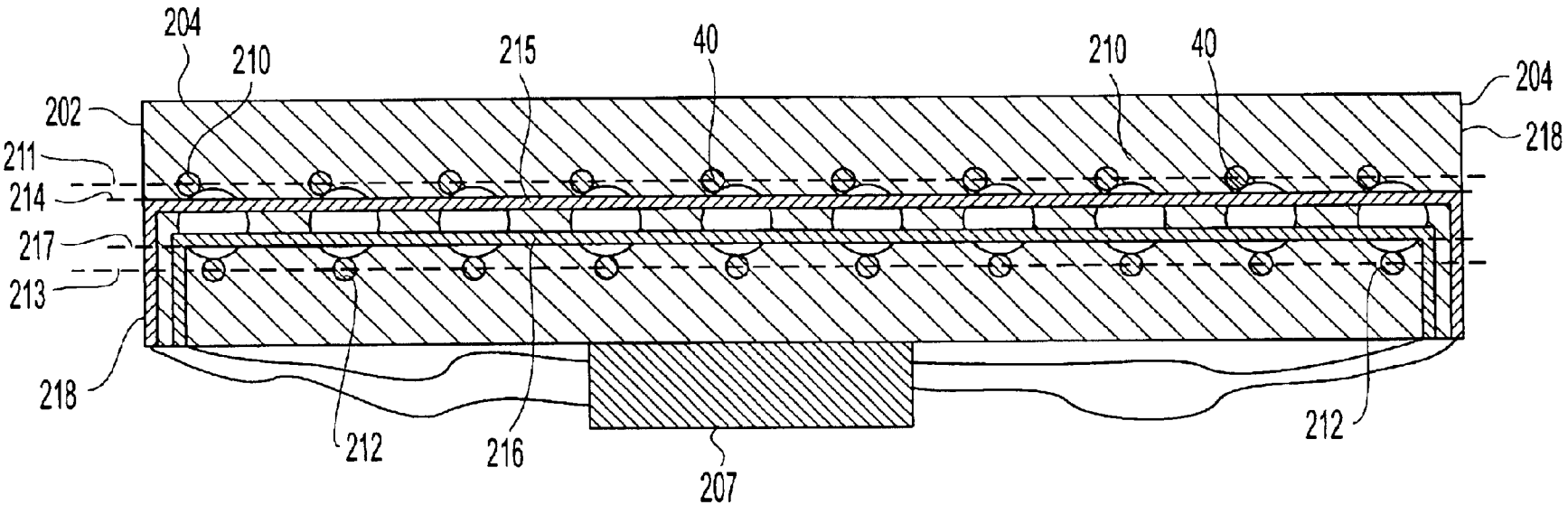
FIG. 19 is a view of another embodiment of the panel of in the view of FIG. 18.

In another embodiment shown in FIG. 19 and referred to as a electrode embodiment because it contains two sustain electrodes and two triggering electrodes for a total of four electrodes to address each micro-component 40, the triggering electrodes 206 are arranged orthogonal to the first and second sets of sustain electrodes 210, 212. Similar to the triode arrangement, the triggering electrodes include a first set of triggering electrodes 215 contained in the third plane 214 that parallel to the first plane 211 and disposed between the first and second planes. In this embodiment, the triggering electrodes also include a second set of triggering electrodes 216 arranged in a fourth plane 217 parallel to the first plane 211, spaced from the third plane 214, and located between the first and second planes. Other tetrode arrangements are also possible as shown for example in FIG. 14.

Figure 18:
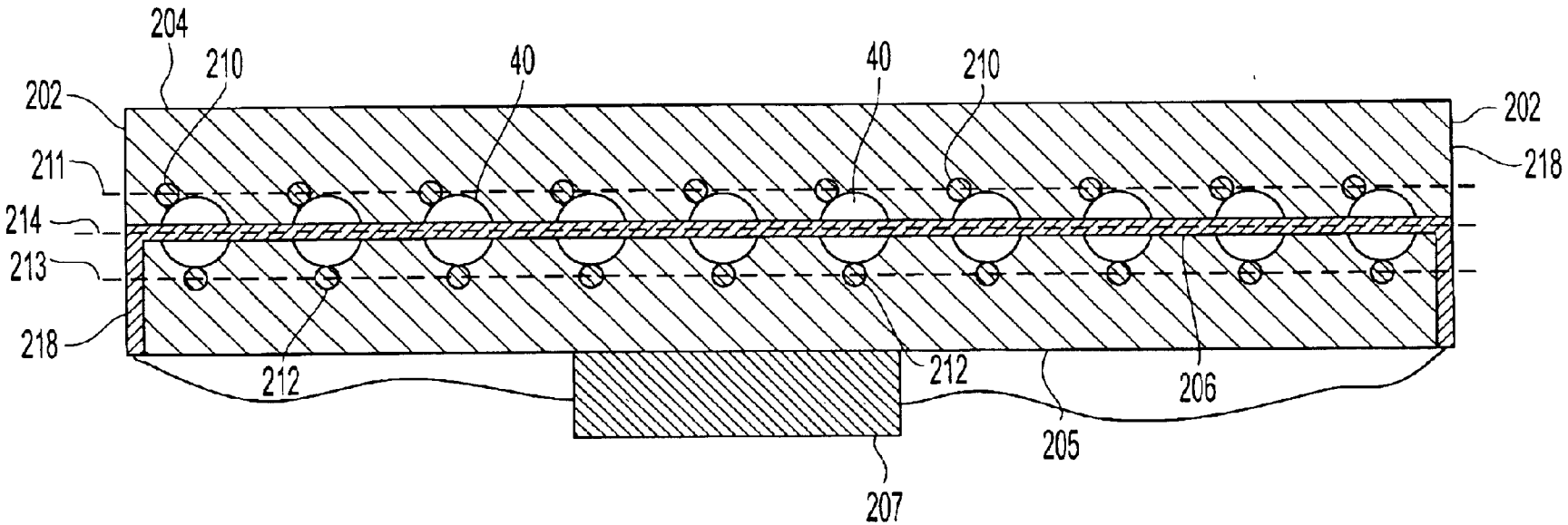
FIG. 18 is a view of an embodiment of the panel through line 18—18 of FIG. 16.

The light-emitting display 200 can be constructed from at least one of these panels 201. Preferably, the light-emitting display includes a plurality of the panels 201 arranged in the configuration and shape of the desired display 200 and electrically coupled together. The triggering electrodes 206 can be connected to the micro-components through the back 205 of each of the panels 201, or each panel 201 can have the micro-components 40 contained therein addressed by an addressing driver or voltage source 207 attached to that panel 201 as shown in FIGS. 18 and 19. The plurality of voltage sources 207 are electrically coupled to the triggering electrodes 206 at or adjacent the junctions 208 between the panels 201. The triggering electrodes 206 are preferably arranged in parallel rows that are parallel to either the rows 208 or columns 209 of the panel 201 and perpendicular to the sustain electrodes 210, 212. The plurality of sustain electrodes 210, 212 are electrically coupled to each micro-component 40 and are capable of simultaneously subjecting all of the micro-components 40 in the entire light-emitting display 200 to a voltage less than the triggering voltage. Connections to a sustain voltage source are made at the edges 219 of the display 200, and electrical connectivity or continuity among the sustain electrodes in the various panels 210, 212 is maintained at the junctions 218 of the panels 201 (FIG. 15).

The arrangement of the light emitting display 200 utilizing panels 201 as basic units in larger displays provides benefits and advantages in the manufacture and application of the light-emitting display 200. Since each panel 201 contains its own set of triggering electrodes, voltage sources and drivers, all of the micro-components 40 in the display do not have to be addressed or triggered as a single display where electrical connections to the triggering electrodes are only made at the edges 219 of the display 200 and all of the micro-components in a row or column of the entire display can only be addressed as a single long series of micro-components. The display 200 is broken down into units or panels and individual micro-components are addressed on a panel-by-panel basis or in a parallel manner. This facilitates the assembly and construction of larger displays, avoids the problems of signal attenuation associated with long lengths of electrodes, and eliminates the problem of increased address times associated with pulse separation in series-type addressing schemes. Further, since the voltages and currents used to sustain and trigger the micro-components 40 generate radio frequencies that interfere with other electronic devices, these radio frequencies must be shielded. Bringing the triggering electrodes through the back 205 of the panels 201, either directly or at the panel junctions 218, makes it easier to shield these generated frequencies.

The panels 201 can be physically cut from an assembled web during a continuous manufacturing process or can be defined on a larger display by connecting the individual display panels. The size selected for each panel 201 is preferably the most efficient for making the variety of sizes of light-emitting displays 200 desired. Preferably, the panels 201 are the smallest pieces or units of a display 200 and are not further divided or cut during manufacture.

The triggering voltages can be applied directly by the triggering electrodes 216, particularly in the tetrode configuration, or can be applied by combining voltages from the sustain and triggering electrodes. Since the cost of the electronics to handle the addressing and triggering of the micro-components increases significantly at higher voltages, it is desirable to decrease or minimize the triggering voltage necessary to cause the micro-components 40 to emit radiation.

One solution is to apply to the micro-component 40 a sustain voltage that is below the triggering voltage. The triggering electrodes 206 would then supply the additional voltage to selected micro-components 40 necessary to trigger emissions. The sustain voltage is applied to all of the micro-components simultaneously through a common electrical bus (not shown) located at the edges 219 of the display 200. In addition to requiring a lower triggering voltage, this arrangement facilitates the use of sustain electrodes 210, 212 near the front 204 and back 205 of the panels 201 or display 202 where the use of high conductivity metals can be more easily implemented. The triggering voltages would then be applied at interstitial layers where high conductivity materials may be difficult to implement.

Plasma displays emit RF radiation that must be shielded to protect other electronic equipment that is located near the display. In the present invention using a micro-component-based display structure, the panel structure is thinner than conventional plasma display structures, and the drive electronics can be mounted on the back surface of the panel. This allows the connections between the drive electronics and the plasma discharges to be shorter, meaning that the RF radiators are smaller and less effective as radiators. Therefore, the RF shielding requirements of the present invention are less than conventional plasma displays.

Figure 20:
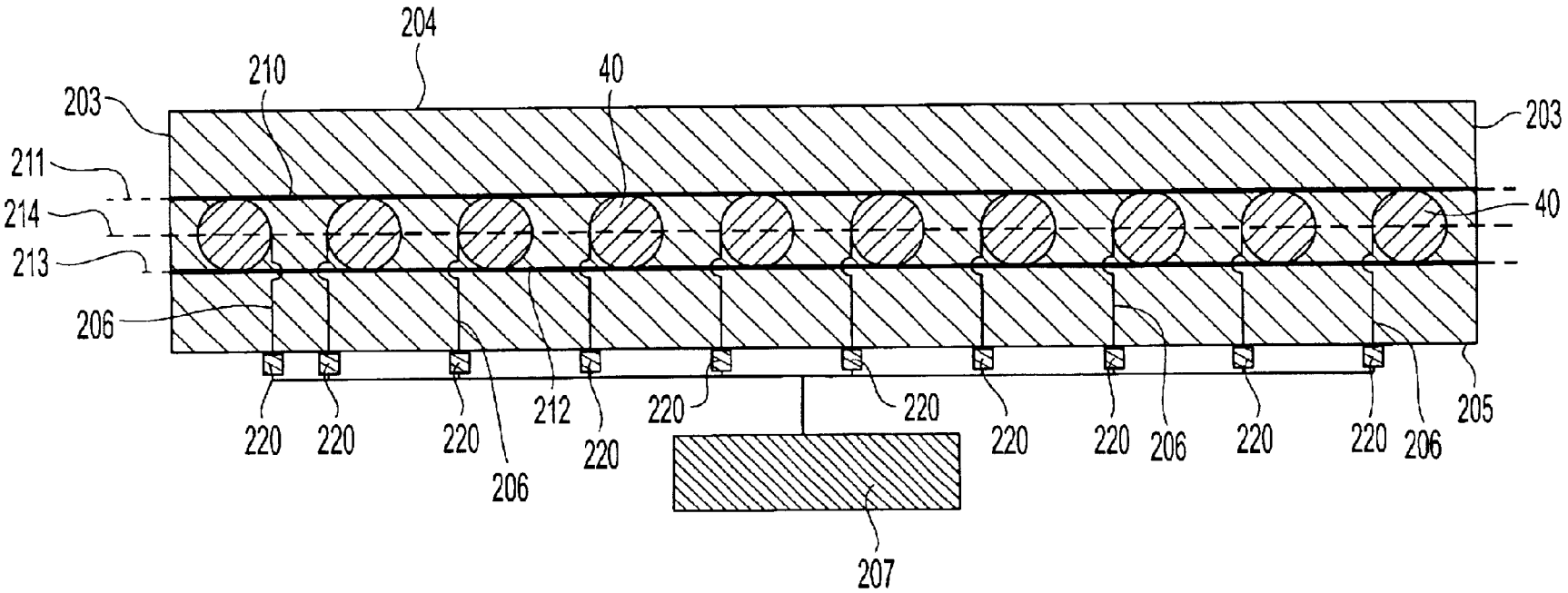
FIG. 20 is another embodiment of the view of FIG. 17 containing voltage multipliers.

In another embodiment as shown, for example in FIG. 20 of the present invention, a voltage multiplier or voltage multiplying circuitry 220 is electrically coupled between the voltage source 207 and the triggering electrode 206. Suitable voltage multipliers 220 are capable of increasing a supply voltage from the voltage source 220 to the triggering voltage. In one embodiment, the supply voltage or address voltage can be up to about 20 volts. In another embodiment, the supply voltage is about 10 volts. In order to achieve the necessary voltages to trigger an emission in the selected micro-components 40, suitable voltage multipliers 220 are capable of multiplying a supply voltage from the voltage source 207 by a factor of at least 5. Any type of circuitry capable of producing the necessary voltage increase can be used in the voltage multiplier 220 of the present invention. For example, the voltage multiplier 220 can be a capacitive multiplier. In addition, the voltage multiplier 220 can contain thin film transistors.

The voltage multiplier 220 can be used in combination with the various micro-component 40 and electrode configurations of the light-emitting displays 200, assembled webs, and panels 201 of the present invention. For example, the voltage multiplier 220 can be combined with the triode and tetrode configurations. In addition, the voltage multiplier 220 can be combined with the back-plane-type addressing or can be employed by itself in the end-type addressing schemes. For example, the light-emitting display 200 of the present invention containing at least one panel 201 having a plurality of micro-components 40, at least one triggering electrode 206 electrically coupled to at least one of the micro-components 40, and at least one voltage source 207 electrically coupled to the triggering electrode 206 can include the voltage multiplier 220 of the present invention electrically coupled between the voltage source 207 and the triggering electrode 206.

Figure 21:
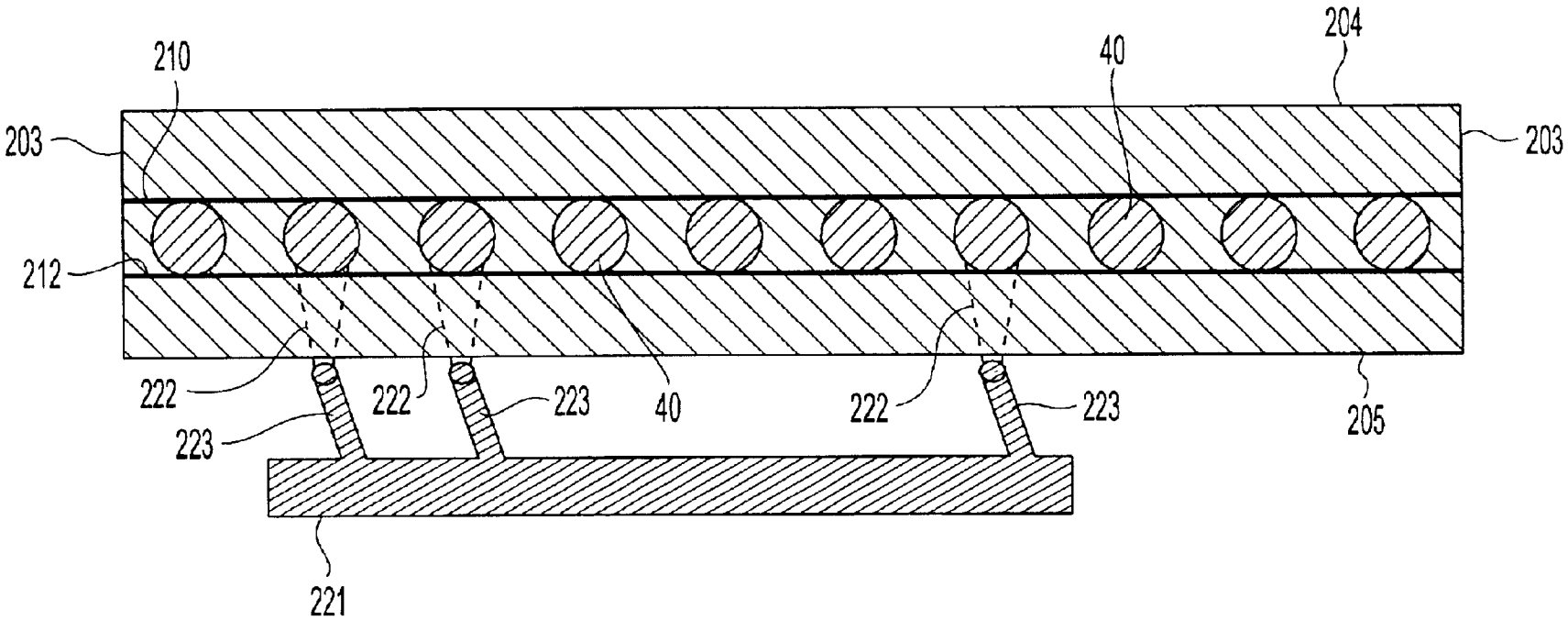
FIG. 21 is a schematic representation of the view of FIG. 17 of an embodiment of the panel for use with photo-addressing.

In addition to decreasing the voltages necessary to trigger the micro-components 40 and decreasing the length of the triggering electrodes 206 through a back-plane-type addressing arrangement, additional arrangements of the present invention further decrease the amount and size of the electronics necessary to operate the light-emitting display 200 of the present invention by decreasing the number of electrodes required to operate the display. Since the micro-components are light or photosensitive, a light or photon source can be used to address selected micro-components 40 in the light-emitting display. For example, the light-emitting display 200 can include a plurality of micro-components 40 electrically coupled to a plurality of sustain electrodes 210, 212 that are capable of simultaneously subjecting all of the micro-components 40 to a sustain voltage less than the triggering voltage as described above. As is best shown in FIG. 21, a light delivery device 221 is provided that is capable of simultaneously delivering an amount of light 222 to one or more selected micro-components 40. The amount of light 222 directed to the selected micro-components 40 is sufficient to create enough free charges, electrons, photoelectrons or carriers in the gas contained in the selected micro-components 40 to depress the required triggering voltage of the gas to a level less than the applied sustain voltage.

Figure 22:
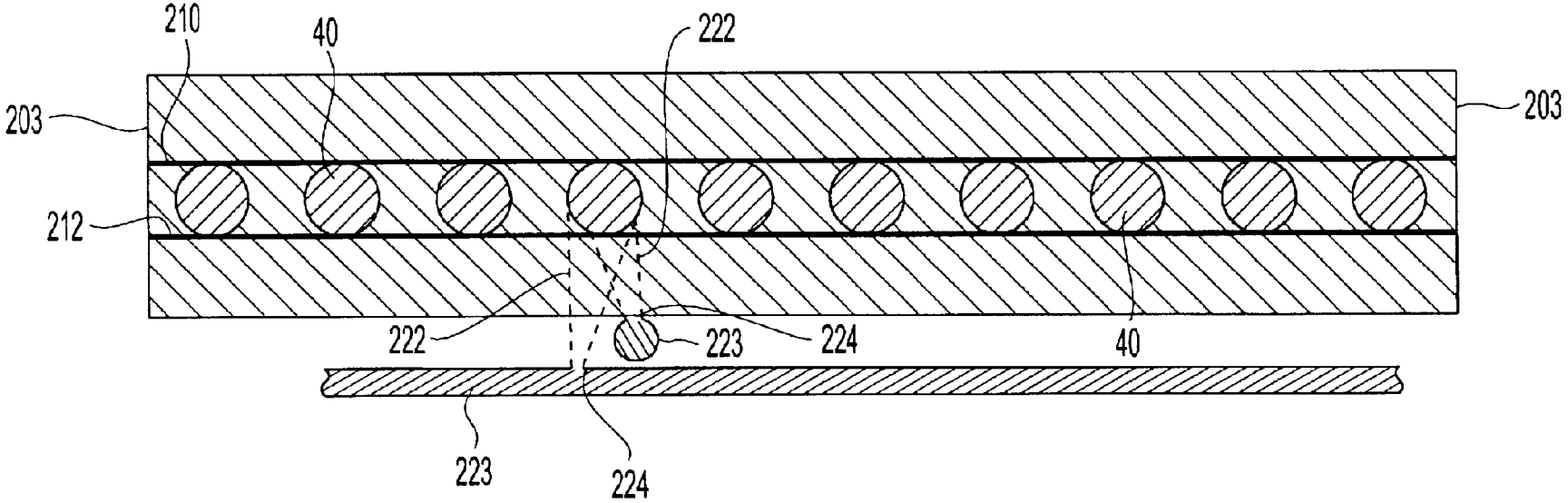
FIG. 22 is a schematic representation of another embodiment of a panel of FIG. 21 photo-addressing.

Any number of light delivery devices are suitable for use in the present invention to deliver the sufficient amount of light. The light delivery device includes at least one light source. Suitable light sources include lasers, incandescent lights, fluorescent lights, light emitting diodes, and combinations thereof. In addition to the source of light itself, the light delivery device includes a delivery mechanism 223. In one embodiment, the delivery mechanism includes a plurality of optical fibers. Preferably, as illustrated in FIG. 22, these optical fibers 223 contain points or holes 224 that allow amounts of light 222, preferably controllable amounts of light, to pass from or leak out of the optical fiber 223 at predefined or controllable locations. The light delivery device 221 may also contain one or more optical filters, lenses, mirrors, or combinations thereof to direct and control the delivered light 222 as necessary. The light may also be delivered by the waveguides in an integrated photonics system, by a dielectric wedge with controlled escape of internally reflected light across its width, and/or by free-space scanning of one or more laser beams. Since triggering is accomplished with directed light, triggering electrodes are not needed. Therefore, a pure two sustain electrode 210, 221 system can be used.

Figure 23:
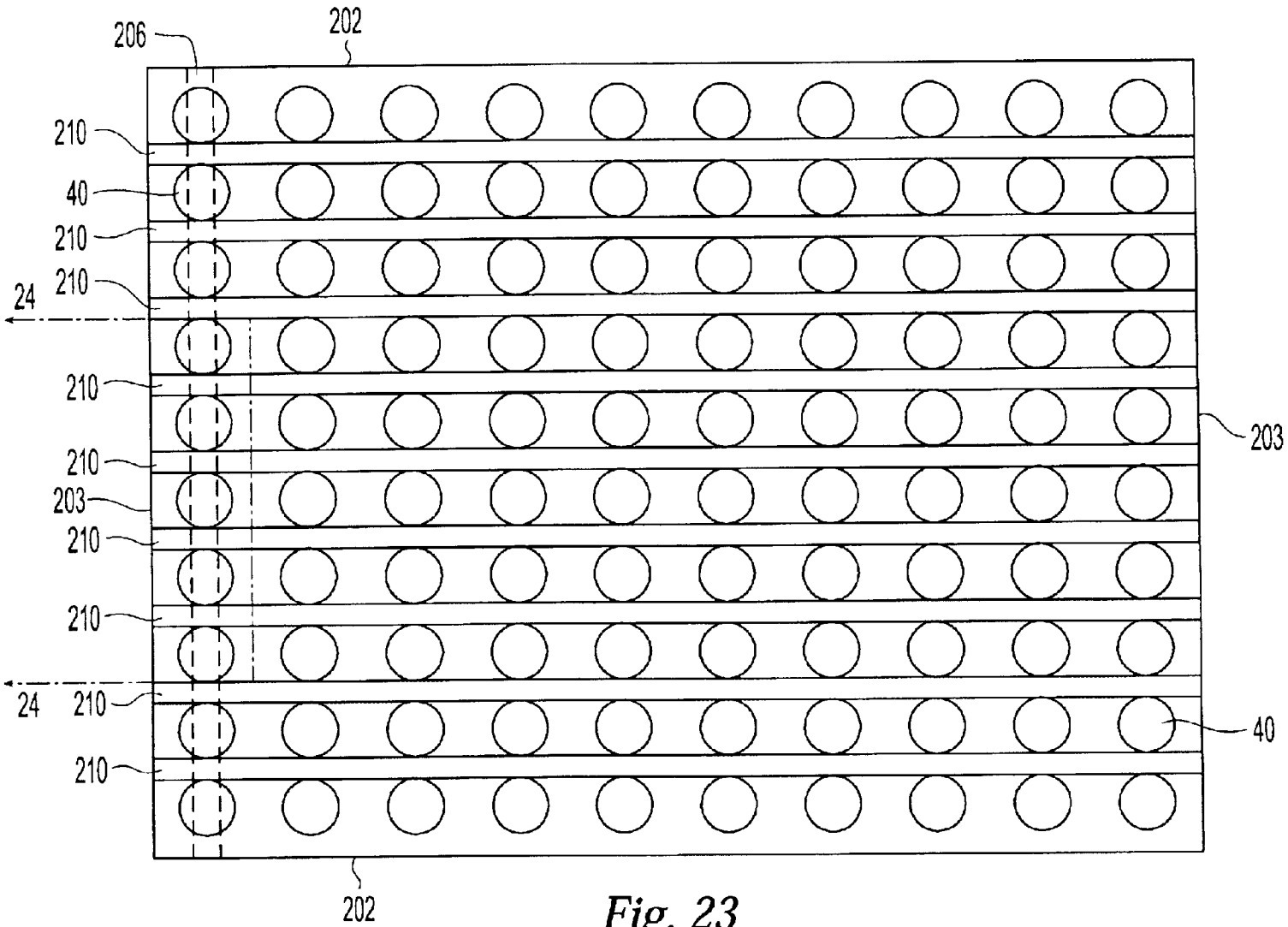
FIG. 23 is a schematic representation from the front of an embodiment of the panel providing for a decreased number of sustain electrodes.
Figure 24:
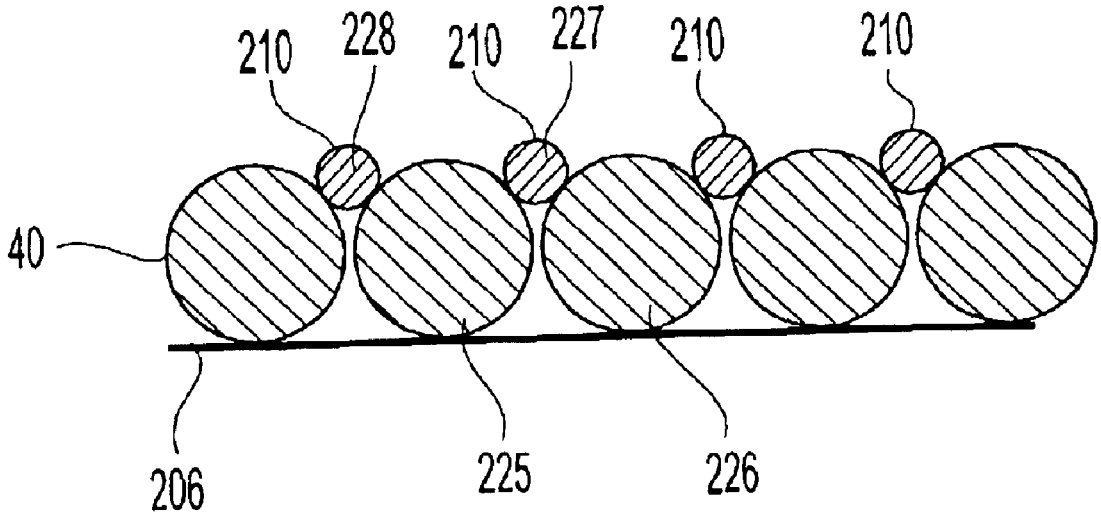
FIG. 24 is a view through line 24—24 of FIG. 23.

Referring to FIGS. 23 & 24 in addition to eliminating the triggering electrodes 206 or as an alternative to eliminating the need for triggering electrodes 206, configurations of the light-emitting display 200 of the present invention are possible which decrease or minimize the number of sustain electrodes 210, 212 in the display 200. For example, the light-emitting display 200 can include a plurality of sustain electrodes 210 arranged in a plurality of parallel rows and a plurality of trigger electrodes 206 perpendicularly crossing the sustain electrodes 210 to form a grid. Each of the plurality of micro-components 40 contained in the display 200 is electrically coupled to the trigger electrodes 206 and disposed between and electrically coupled to two adjacent parallel rows of sustain electrodes 210 so as to increase the fill factor between adjacent micro-components. The fill factor is a measurement of the amount of dark space between the adjacent rows of micro-components. Decreasing the fill factor decreases the amount of dark space.

In order to address selected micro-components in this decreased sustain electrode configuration a triggering or addressing voltage is simultaneously delivered to at least two micro-components 225, 226 disposed in adjacent parallel rows using one address electrode 206 and one sustain electrode 227 that is electrically coupled to both micro-components 225, 226 and generally disposed there between. The actual micro-component 225 of the two micro-components 225, 226 to be sustained is selected, and a sustaining voltage is supplied to that micro-component 225 through the two sustain electrodes 227, 228 located on either side of the selected micro-component 225. Selection of the micro-components 225, 226 to be triggered is handled by the controller and control circuitry for the light-emitting display. Preferably, the control logic used will address and sustain the micro-components so that only one of the two micro-components initially addressed will actually be fully triggered to emission.

When the apparatus for photo-addressing selected micro-components is used, all of the micro-components in the panel or light-emitting display are simultaneously exposed to a sustain voltage less than the triggering voltage necessary to cause the gas contained in the micro-components to emit radiation. The one or more gas containing micro-components to be energized are selected, and an amount of light 222 sufficient to create enough free charges to depress the required triggering voltage in the selected micro-components 40 to a level less than the applied sustain voltage is delivered to each selected micro-component. These micro-components 40 are then triggered to emit radiation and are sustained or terminated as desired by voltages delivered through the sustain electrodes 210, 212. In one embodiment, at least two independent light sources, light delivery devices, or light delivery mechanisms that combine to create the sufficient amount of light are delivered to the selected micro-components. Preferably, optical fibers, waveguides in an integrated photonics system, a dielectric wedge with controlled escape of internally reflected light across its width, free-space scanning of one or more laser beams, or a combination of these are used to provide the two independent light sources.

In order to address selected micro-components in a panel 201 or display 200 using the voltage multiplier 200 of the present invention, one or more gas containing micro-components 40 to be energized or triggered are selected and are addressed using an addressing voltage less than the triggering voltage necessary to cause the contained gas to emit radiation. This address voltage is then increased to a level that is at least equal to the triggering voltage. This increased voltage is delivered to the micro-component, and the gas is energized. In an alternative embodiment, the address voltage is increased to a level less than the triggering voltage but sufficient to combined with other applied voltages, such as the sustain voltage, to trigger the selected micro-components 40. In this embodiment, all of the micro-components 40 are simultaneously exposed to a sustain voltage less than the triggering voltage.

In order to address the light-emitting display 200 of the present invention as a plurality of connected panels 201 or unit displays, the display is divided, either physically or logically, into a plurality of the panels 201 of the present invention. The micro-components 40 to be energized are then selected and addressed in each panel separately. That is the micro-components are identified not only by location in the display 200 but also by panel 201 and location within that panel 201. Once adequately addressed, a triggering voltage is delivered to the selected micro-components. In one embodiment, at least one addressing device or voltage source 207 is provided for each panel 201, and the addressing device is attached directly to the panel 201. Preferably, the addressing device is used to address the selected micro-components in the panel 201 to which it is attached.

Other embodiments and uses of the present invention will be apparent to those skilled in the art from consideration of this application and practice of the invention disclosed herein. The present description and examples should be considered exemplary only, with the true scope and spirit of the invention being indicated by the following claims. As will be understood by those of ordinary skill in the art, variations and modifications of each of the disclosed embodiments, including combinations thereof, can be made within the scope of this invention as defined by the following claims.

What is claimed is:

1. A panel for use in a light-emitting display, the panel comprising:

a first set of opposing edges;

a second set of opposing edges;

a front bordered by the first and second opposing edges and comprising a plurality of micro-components capable of emitting radiation when exposed to a triggering voltage;

a back opposite the front;

at least one triggering electrode electrically coupled to at least one of the micro-components, the triggering electrode passing through the panel to the back; and at least one voltage source electrically coupled to the triggering electrode at the back between the first and second sets of edges.

2. The panel of claim 1, wherein the voltage source is capable of supplying a triggering voltage to the micro-components through the triggering electrode.

3. The panel of claim 1, further comprising:

a plurality of triggering electrodes electrically coupled to the plurality of micro-components; and a plurality of voltage sources electrically coupled to the plurality of triggering electrodes.

4. The panel of claim 1, wherein the plurality of micro-components are arranged in a grid pattern having a plurality of parallel rows and a plurality of parallel columns perpendicular to the plurality of rows, each micro-component disposed at a point of intersection of a row and column.

5. The panel of claim 4, further comprising:

a plurality of parallel sustain electrodes electrically coupled to the micro-components.

6. The panel of claim 5, wherein the sustain electrodes are arranged parallel to one of the rows and columns.

7. The panel of claim 6, wherein the sustain electrodes further comprise:

a first set of sustain electrodes disposed in a first plane parallel to the front and back; and a second set of sustain electrodes disposed in a second plane spaced from the first plane and parallel thereto.

8. The panel of claim 7, further comprising a plurality of parallel triggering electrodes electrically coupled to the plurality of micro-components.

9. The panel of claim 8, wherein the triggering electrodes are perpendicular to the first and second sets of sustain electrodes and are arranged in a third plane parallel to the first plane and disposed between the first and second planes.

10. The panel of claim 8, wherein the triggering electrodes further comprise:

a first set of triggering electrodes perpendicular to the first and second sets of sustain electrodes and arranged in a third plane parallel to the first plane and disposed between the first and second planes; and a second set of triggering electrodes perpendicular to the first and second sets of sustain electrodes and arranged in a fourth plane parallel to the first plane, spaced from the third plane, and disposed between the first and second planes.

11. The panel of claim 1, further comprising a voltage multiplier electrically couple between the voltage source and the triggering electrode.

12. The panel of claim 11, wherein the voltage multiplier is capable of increasing a supply voltage from the voltage source to the triggering voltage.

13. The panel of claim 12, wherein the supply voltage is about 10 volts.

14. The panel of claim 11, wherein the voltage multiplier is capable of multiplying a supply voltage from the voltage source by a factor of at least 5.

15. The panel of claim 11, wherein the voltage multiplier is a capacitive multiplier.

16. The panel of claim 11, wherein the voltage multiplier comprises thin film transistors.

17. A light-emitting display comprising at least one panel according to claim 1.

18. The light-emitting display of claim 17, comprising a plurality of the panels electrically coupled together.

19. A light-emitting display comprising:

a plurality of panels electrically coupled to one another at a plurality of junctions, each panel comprising:

a plurality of micro-components capable of emitting radiation when exposed to a triggering voltage of sufficient strength, the micro-components arranged in a grid comprising a plurality of rows and plurality of columns perpendicular to the rows;

a plurality of sustain electrodes electrically coupled to each micro-component and capable of simultaneously subjecting all of the micro-components to a voltage less than the triggering voltage;

a plurality of triggering electrodes electrically coupled to each micro-component; and a plurality of voltage sources electrically coupled to the triggering electrodes at the junctions.

20. A light-emitting display comprising:

a plurality of micro-components capable of emitting radiation when exposed to a triggering voltage;

a plurality of sustain electrodes electrically coupled to each micro-component and capable of simultaneously subjecting all of the micro-components to a sustain voltage less than the triggering voltage;

a light delivery device capable of simultaneously delivering an amount of light to one or more selected micro-components, the amount of light sufficient to create enough free charges in the selected micro-components to depress the required triggering voltage in the selected micro-components to a level less than the applied sustain voltage.

21. The light-emitting display of claim 20, wherein the light delivery device comprises at least one light source.

22. The light-emitting display of claim 21, wherein the light source is a laser, an incandescent light, a fluorescent light, or a light emitting diode.

23. The light-emitting display of claim 21, wherein the light delivery device further comprises a delivery mechanism.

24. The light-emitting display of claim 23, wherein the delivery mechanism comprises a plurality of optical fibers.

25. The light-emitting display of claim 23, wherein the delivery mechanism further comprises lenses or mirrors.

26. A light-emitting display comprising:

a plurality of sustain electrodes arranged in a plurality of parallel rows;

a plurality of trigger electrodes perpendicularly intersecting the sustain electrodes to form a grid;

a plurality of micro-spheres capable of emitting radiation when exposed to a triggering voltage of sufficient strength, each micro-sphere electrically coupled to the trigger electrodes and disposed between and electrically coupled to two adjacent parallel rows of sustain electrodes so as to increase the fill factor between adjacent micro-spheres.

27. A light-emitting display comprising:

a panel comprising a plurality of micro-components capable of emitting radiation when exposed to a triggering voltage;

at least one triggering electrode electrically coupled to at least one of the micro-components;

at least one voltage source electrically coupled to the triggering electrode; and a voltage multiplier electrically couple between the voltage source and the triggering electrode.

28. The display of claim 27, wherein the voltage multiplier is capable of increasing a supply voltage from the voltage source to the triggering voltage.

29. The display of claim 28, wherein the supply voltage is about 10 volts.

30. The display of claim 27, wherein the voltage multiplier is capable of multiplying a supply voltage from the voltage source by a factor of at least 5.

31. The panel of claim 27, wherein the voltage multiplier is a capacitive multiplier.

32. The panel of claim 27, wherein the voltage multiplier comprises thin film transistors.

33. A method for addressing one or more micro-components selected from a plurality of micro-components in a light emitting display by triggering a gas contained within the selected micro-components to emit radiation, the method comprising:

selecting one or more gas containing micro-components to be energized;

addressing the selected micro-components using an addressing voltage less than the triggering voltage necessary to cause the gas to emit radiation;

increasing the addressing voltage to at least the triggering voltage; and energizing the gas.

34. The method of claim 33, wherein:

the method further comprises simultaneously exposing all of the micro-components to a sustain voltage less than the triggering voltage; and the step of increasing the addressing voltage further comprises increasing the addressing voltage to a level such that the sum of the increased addressing voltage and the sustain voltage at the selected micro-components is at least equal to the triggering voltage.

35. The method of claim 33, wherein the address voltage is about 10 volts.

36. The method of claim 33, wherein the step of increasing the addressing voltage multiplies the addressing voltage by a factor of at least five.

37. A method for addressing one or more micro-components selected from a plurality of micro-components in a light emitting display by triggering a gas contained within the selected micro-components to emit radiation, the method comprising:

dividing the display into a plurality of panels;

selecting one or more gas containing micro-components to be energized;

addressing the selected micro-components in each panel separately;

delivery a triggering voltage to the selected micro-components sufficient to cause the gas in the selected micro-components to emit radiation.

38. The method of claim 37, further comprising providing at least one addressing device for each panel.

39. The method of claim 38, wherein the addressing device is attached to the panel.

40. The method of claim 39, wherein the addressing device is used to address the selected micro-components in the panel to which it is attached.

41. The method of claim 37, further comprising:

addressing the selected micro-components using an addressing voltage less than the triggering voltage necessary to cause the gas to emit radiation; and increasing the addressing voltage to at least the triggering voltage.

42. A method for addressing one or more micro-components selected from a plurality of micro-components in a light emitting display by triggering a gas contained within the selected micro-components to emit radiation, the method comprising:

simultaneously exposing all of the micro-components to a sustain voltage less than the triggering voltage necessary to cause the gas contained in the micro-components to emit radiation;

selecting one or more gas containing micro-components in to be energized;

delivering to each selected micro-component an amount of light sufficient to create enough free charges in the selected micro-components to depress the required triggering voltage in the selected micro-components to a level less than the applied sustain voltage.

43. The method of claim 42, wherein the step of delivering a sufficient amount of light comprises causing at least two independent light sources that combine to create the sufficient amount of light to deliver this combined light to the selected micro-components.

44. The method of claim 43, wherein the light sources comprise optical fibers.

45. A method for addressing one or more micro-components selected from a plurality of micro-components in a light emitting display by triggering a gas contained within the selected micro-components to emit radiation, the method comprising:

arranging the micro-components in a plurality of parallel rows;

providing a plurality of sustain electrodes arranged parallel to the micro-component rows, each sustain electrode disposed between adjacent rows of micro-components and electrically connected to the micro-components in those rows;

providing a plurality of address electrodes arranged perpendicular to the sustain electrodes and the rows of micro-components;

simultaneously delivering a triggering voltage to at least two micro-components disposed in adjacent rows using one address electrode and one sustain electrode disposed between the adjacent rows;

selecting a micro-component to be sustained; and sustaining that micro-component by supplying a sustaining voltage to the micro-component through two sustain electrodes located on either side of the selected micro-component.

46. The method of claim 45, wherein the sustain electrodes are disposed between adjacent rows of micro-components so as to increase the fill factor between the rows of micro-components.

* * * * *